US005445464A

United States Patent [19]

Asakura et al.

[11] Patent Number: 5,445,464

[45] Date of Patent: Aug. 29, 1995

[54] INK RIBBON USAGE IN A MULTICOLOR IMAGE RECORDING APPARATUS

[75] Inventors: Osamu Asakura, Tokyo; Yoshio Uchikata, Yokohama; Kenji Kawazoe; Yuji Kanome, both of Kawasaki, all of Japan

[73] Assignee: Canon Kabushiki Kaisha, Tokyo, Japan

[21] Appl. No.: 345,355

[22] Filed: Nov. 18, 1994

Related U.S. Application Data

[63] Continuation of Ser. No. 126,760, Sep. 27, 1993, abandoned, which is a continuation of Ser. No. 16,177, Jan. 25, 1993, abandoned, which is a continuation of Ser. No. 555,819, Jul. 23, 1990, abandoned, which is a continuation of Ser. No. 160,292, Feb. 25, 1988, abandoned.

[30] Foreign Application Priority Data

| | | | |
|---|---|---|---|
| Feb. 27, 1987 | [JP] | Japan | 62-043085 |
| Feb. 27, 1987 | [JP] | Japan | 62-043086 |
| Feb. 27, 1987 | [JP] | Japan | 62-043087 |
| Feb. 27, 1987 | [JP] | Japan | 62-043088 |
| Feb. 27, 1987 | [JP] | Japan | 62-043089 |
| Feb. 27, 1987 | [JP] | Japan | 62-043091 |
| Feb. 27, 1987 | [JP] | Japan | 62-043092 |

[51] Int. Cl.[6] ..... B41J 33/54; B41J 35/16

[52] U.S. Cl. ..... 400/249; 400/120.04; 400/225; 347/178

[58] Field of Search ..... 400/120.02, 120.04, 400/225, 240.3, 240.4, 249; 347/172, 174, 176, 177, 178

[56] References Cited

U.S. PATENT DOCUMENTS

| | | | |
|---|---|---|---|
| 4,469,459 | 9/1984 | Trezise et al. | 400/216.1 |
| 4,496,955 | 1/1985 | Maeyama et al. | 400/120 X |
| 4,502,057 | 2/1985 | Kawano et al. | 400/120 X |
| 4,573,059 | 2/1986 | Shinma et al. | 400/120 X |
| 4,616,236 | 10/1986 | Watanabe et al. | 400/240.4 |
| 4,636,097 | 1/1987 | Goubeaux | 400/249 |
| 4,642,655 | 2/1987 | Sparer et al. | 400/120 X |
| 4,652,154 | 3/1987 | Horiya et al. | 400/249 X |
| 4,710,781 | 12/1987 | Stephenson | 400/120 X |
| 4,797,016 | 1/1989 | Lahr | 400/249 |

FOREIGN PATENT DOCUMENTS

| | | | |
|---|---|---|---|
| 0100776 | 2/1984 | European Pat. Off. | 400/249 |
| 81188 | 5/1983 | Japan | 400/240.4 |
| 0057761 | 4/1984 | Japan | 400/120 |
| 0057762 | 4/1984 | Japan | 400/120 |
| 59-218886 | 12/1984 | Japan . | |
| 60-19580 | 1/1985 | Japan . | |
| 60-23090 | 2/1985 | Japan | 400/240.3 |
| 60-51055 | 4/1985 | Japan . | |
| 60-155477 | 8/1985 | Japan . | |
| 0232989 | 11/1985 | Japan | 400/249 |
| 14972 | 1/1986 | Japan | 400/240.3 |
| 31282 | 2/1986 | Japan | 400/240.4 |
| 61-209188 | 9/1986 | Japan . | |
| 239968 | 10/1986 | Japan | 400/240.4 |

*Primary Examiner*—David A. Wiecking

*Attorney, Agent, or Firm*—Fitzpatrick, Cella, Harper & Scinto

[57] ABSTRACT

An image recording apparatus for recording an image on a recording medium has a plurality of ink ribbon mounting portions on which a multicolor ink ribbon having inks of plural colors and a monochromatic ink ribbon having monochromatic ink can be mounted, a recording head for recording an image on the recording medium, an input circuit for designating the colors of the image to be recorded on the recording medium, and a control unit for controlling the image based on recording information to be recorded by the direction from said input means so that image recording is effected in a smaller number of the recording colors by the recording information. The unused amount of the color blocks on the ribbon is stored in memory to control efficient use of the ribbon.

19 Claims, 22 Drawing Sheets

INK RIBBON USAGE IN A MULTICOLOR IMAGE RECORDING APPARATUS

This application is a continuation of application Ser. No. 08/126,760 filed Sep. 27, 1993, which is a continuation of Ser. No. 08/016,177 filed Jan. 25, 1993, which is a continuation of application Ser. No. 07/555,819 filed Jul. 23, 1990, which is a continuation of application Ser. No. 07/160,292 filed Feb. 25, 1988 all now abandoned.

BACKGROUND OF THE INVENTION

1. Field of the Invention

This invention relates to an image recording apparatus used for image recording in an electronic typewriter, a facsimile apparatus, a personal computer, a word processor or the like. More particularly, it relates to an image recording apparatus capable of obtaining a multicolor image recording in conformity with image information.

2. Related Background Art

As regards multicolor image recording apparatus using ink ribbons, there have been proposed as a first system in which a number of ribbons corresponding to the number of recording colors are piled up, as a second system using a ribbon of great width (a width as great as the number of recording colors times the recording width) on which stripe-like color divisions corresponding to the number of recording colors are provided parallel to the lengthwise (feed) direction of the ribbon (stripe-painted ribbon), and as a third system using a ribbon of the recording width on which different colored portions corresponding to the number of recording colors are repetitively provided in the fashion of stripes perpendicular to the ribbon feed direction (cross-painted ribbon). These systems have their own merits and demerits.

For example, in the first system, the number of ribbons piled up increases with the number of recording colors, and this leads to the bulkiness of the apparatus and sometimes leads to the complexity of the change-over of the ribbons.

In the second system, the width of the ribbon increases with the number of recording colors, and at the same location in the feed direction of the ribbon, only one color can sometimes be used unless the ribbon is rewound, and this leads to the undesirably possibility that the change-over of the ribbon becomes complex. Also, the shift of the ribbon in the widthwise direction thereof is necessary.

In the third system, the use of a single ribbon of the recording width prevents the apparatus from becoming bulky and also eliminates the necessity of a ribbon change-over device or the like, and this third system is most popular at present.

However, even in the third system, ink strips corresponding in number to the recording colors are successively applied to a single ribbon substantially over the same length as the recording length. This generally leads to the undesirable possibility that even when one-color recording is effected, an amount of ribbon the number of colors times the recording length is consumed.

The present invention is suitable for being carried out in a recording apparatus for effecting multicolor recording by the use of a multicolor ink ribbon as described above, particularly, an image recording apparatus using a cross-painted multicolor ribbon which is the above-described third system.

Even in the cross-painted ink ribbon, the length of application of each color is generally set to the maximum value of one recording length plus $\alpha$, and it is rarely the case that recording is effected over the full maximum recording length, and there is the possibility that the second half of one length of application is not used.

Also, the possibility that recording of the same color is effected over several recording lengths is high and in such a case, it has been required that a construction which enables the unused second half of one length of application also to be used be adopted to thereby prevent the waste of the ink sheet to the utmost.

Further, it has also been required that non-recorded portions or portions already recorded in other colors be skipped to thereby enhance the effect of decreasing the waste of the ink sheet and the waste of the operating time.

SUMMARY OF THE INVENTION

It is an object of the present invention to provide an image recording apparatus which can accomplish efficient multicolor image recording.

It is another object of the present invention to provide an image recording apparatus which can accomplish multicolor image recording within a shorter time.

It is still another object of the present invention to provide an image recording apparatus in which consumption of a multicolor ink ribbon can be decreased when multicolor image recording is effected by the use of the multicolor ink ribbon.

It is yet still another object of the present invention to provide an image recording apparatus in which the operation of a multicolor ink ribbon can be decreased when multicolor image recording is effected by the use of a multicolor ink ribbon.

It is a further object of the present invention to provide an image recording apparatus which can solve the problems peculiar to the prior art and in which the consumption and operation of a multicolor ink ribbon can be decreased to the utmost when multicolor recording is effected by the use of the multicolor ink ribbon, whereby efficient multicolor image recording can be executed.

It is still a further object of the present invention to provide a recording apparatus in which an ink ribbon is made multistage and exchangeable to thereby enable monochromatic recording to be economically accomplished without interchanging the ink ribbon and even if information to be recorded such as a trial output for proofreading or an original for monochromatic copies is multicolor, when monochromatic recording outputs are more preferable in terms of cost and time, these recording outputs can be easily executed.

It is yet still a further object of the present invention to provide a multicolor image recording apparatus which can accomplish a variety of monochromatic and multicolor recordings and has a wide range of application.

BRIEF DESCRIPTION OF THE DRAWINGS

FIG. 2(*a*) is a block diagram of the keyboard 1 of FIG. 2;

FIG. 3(*a*) is a plan view of a portion of FIG. 3 showing the connection between the rotor shaft of sheet feed motor M1 and reduction year 7*a*.

DESCRIPTION OF THE PREFERRED EMBODIMENTS

Preferred embodiments of the present invention will be described hereinunder with reference to the accompanying drawings, FIGS. 1–25.

Figure 2:
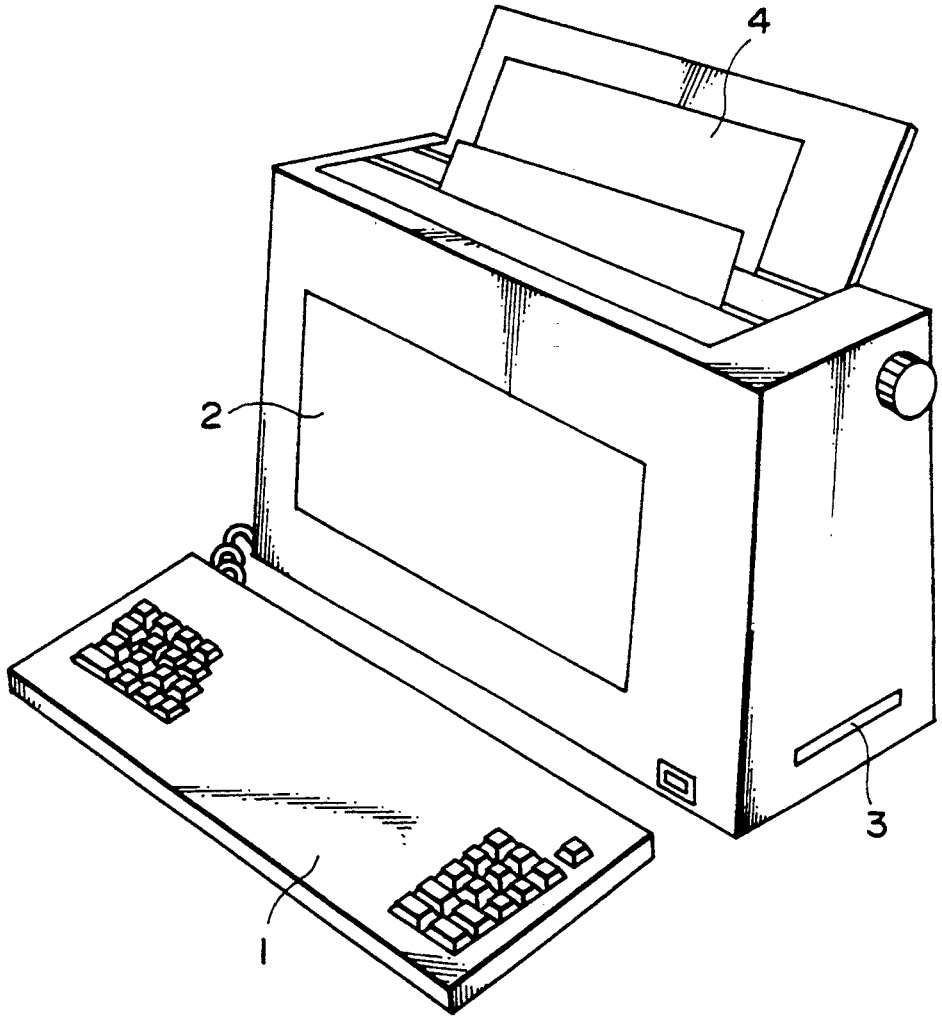
FIG. 2 is a perspective view of a word processor having an image recording apparatus according to the embodiment utilizing the present invention.
Figure 2A:
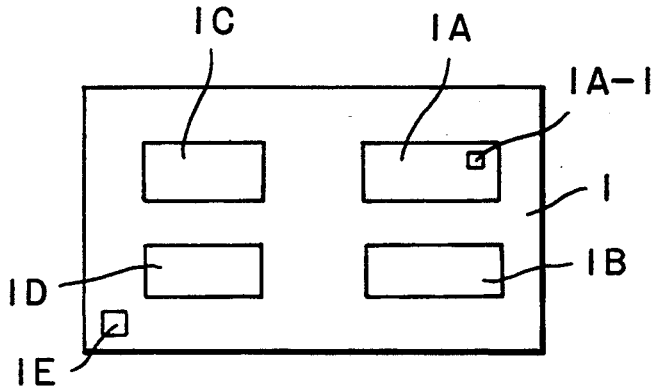

Referring first to FIG. 2 illustrating a word processor having a recording apparatus in accordance with the present invention, a keyboard 1 serving as an input operation section has a plurality of color keys 1A, a plurality of function key 1B, a plurality of numeral keys 1C and a plurality of alphabetic keys 1D, which will be described later. The word processor also has a CRT 2 (or an LCD) serving as a display device, a floppy disk drive FDD 3 capable of loading a floppy disk serving as a memory device, and a recording sheet 4.

Figure 3A:
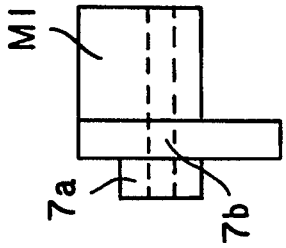
FIG. 3 is a plan view of an image recording apparatus according to the embodiment utilizing the present invention.
Figure 3:
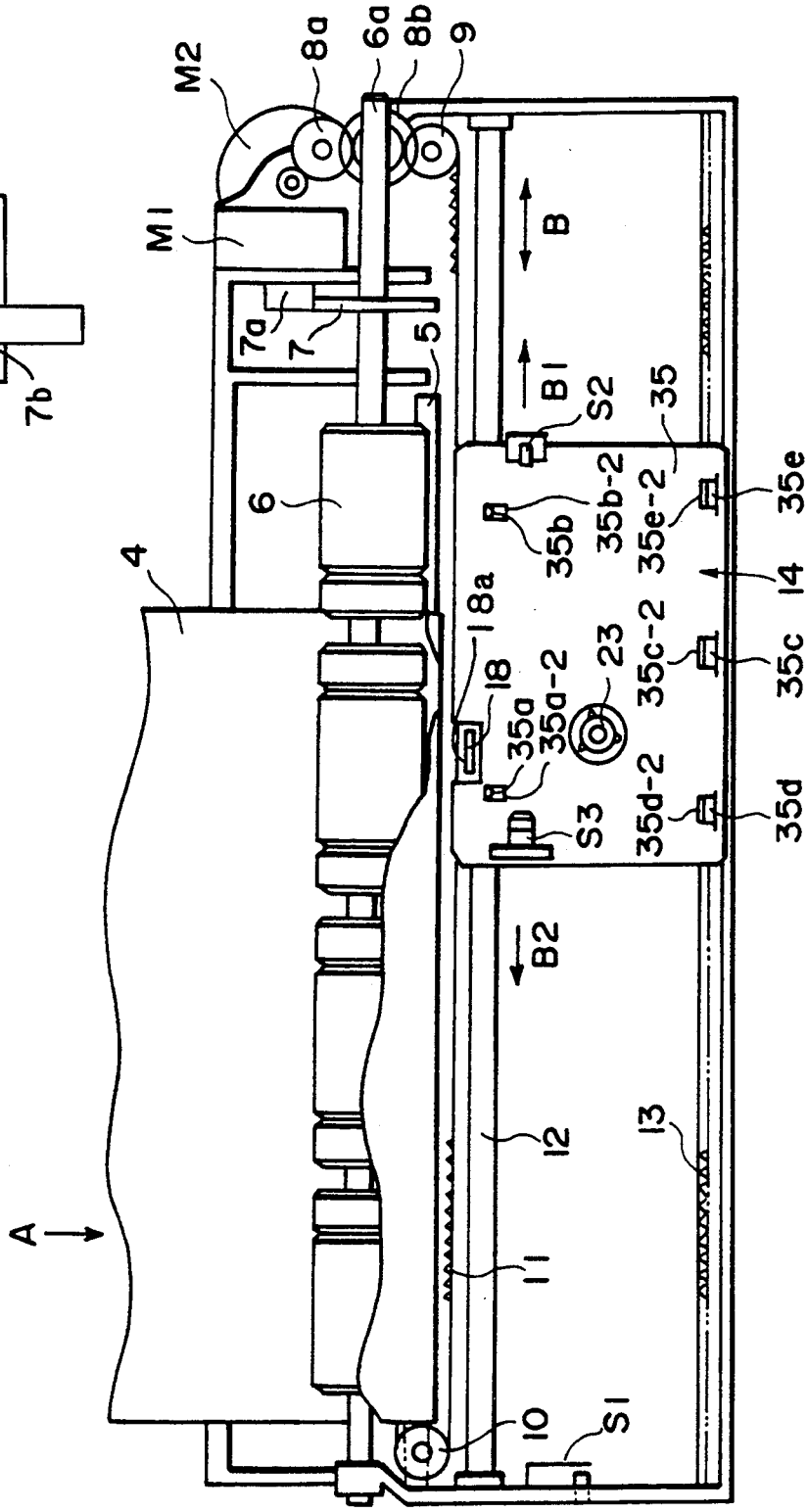
Figure 6:
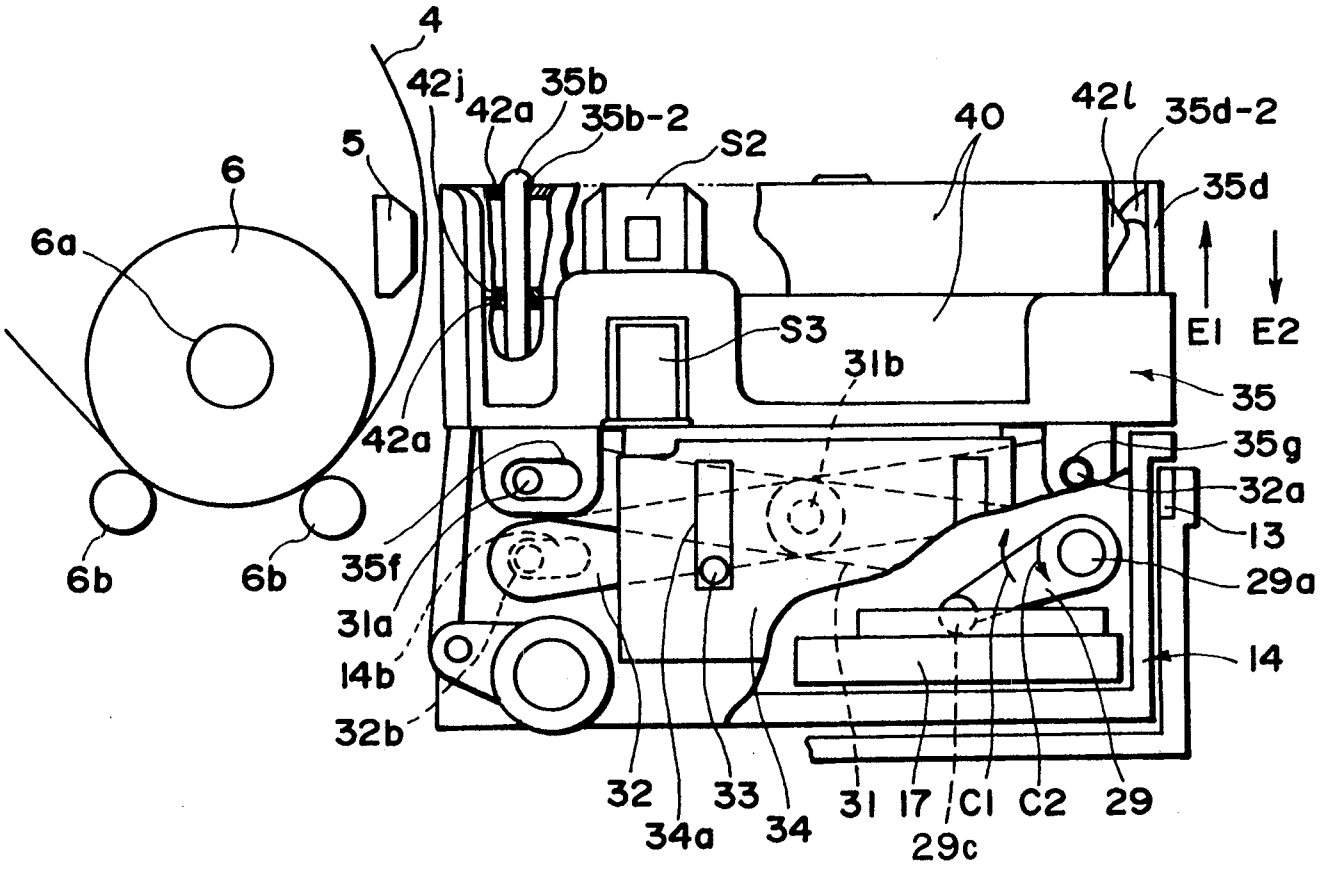
FIG. 6 is a side elevational view of the cassette up/-down mechanism shown in FIG. 5 in a cassette-down state.

Referring now to FIG. 3 showing the construction of a recording section of a recording apparatus in accordance with the present invention, a recording sheet 4 is backed-up by a platen 5 and is pressed onto a rubber portion of a sheet feed roller 6 by means of a pinch roller 6*b* (see FIG. 6). The sheet feed roller 6 is carried by a shaft 6*a* which is provided with a gear 7 which is drivingly connected to the rotor shaft 7*b* of a sheet feed motor M1 through a reduction gear 7*a* by conventional means. As the motor M1 operates, the sheet feed roller 6 is driven to feed the recording sheet 4 forwardly.

Therefore, when a later-mentioned thermal head 18 contacts the recording sheet 4 to effect the recording, the platen 5 securely holds the recording sheet in position.

The recording apparatus has a carriage 14 which is adapted to reciprocally move in a manner which will be explained hereinunder.

The recording apparatus has a shaft 12 extending in parallel with the platen 5 at the front side of the latter. A rack 13 extends in parallel with the shaft 12 along the end of the carriage 14 opposite to the end where the shaft 12 extends. As will be seen also from FIGS. 1 and 6, the carriage 14 is guided and supported by the upper surfaces of the shaft 12 and the rack 13 so as to be movable in the directions indicated by a double-headed arrow B. Thus, the carriage 14 is movable in the direction which is perpendicular to the direction of path A of feed of the recording sheet 4.

A belt 11 has both ends fixed to the carriage 14 and is stretched by a pulley gear 9 and the pulley 10. The pulley gear 9 is connected to a carriage motor M2 through reduction gears 8*a* and 8*b*. As the carriage motor M2 rotates, the pulley gear 9 and the pulley 10 rotate so as to pull the belt 11 in one or the other direction, whereby the carriage 14 is driven along the shaft 12 as indicated by the arrow B. Movement of carriage 14 is in the direction of arrow B1 for printing and arrow B2 for the carriage return function.

The carriage 14 carries a head holder 19 (see FIG. 1) which is swingable about a head holder shaft 19*b*. The head holder 19 holds a thermal head 18 and serves also as a heat sink.

The carriage 14 also carries a carriage table 35 which is capable of mounting a stack of ink ribbon cassettes 40 (see FIGS. 7 and 13) in two stages. The carriage table 35 is provided with a color detection means (color sensor S3) for discriminating the color of a multi-color ribbon 50 (see FIG. 15). The carriage 14 also is provided with a ribbon sensor S2 (see FIG. 3) capable of detecting presence of the ink ribbon cassette 40, as well as the type of the ink ribbon cassette 40 and the end of the ink ribbon 49.

The carriage table 35 is demountably loaded with the stack of ink ribbon cassettes 40 in a manner which will be described hereinunder.

As described before, the carriage table 35 can be loaded with a pair of ink ribbon cassettes 40 in two stages, i.e., one on the other. The carriage table 35 is provided on the upper surface thereof with pins 35*a*, 35*b* and hooks 35*c*, 35*d*, 35*e*.

Illustrating in more detail, the height of the pins 35*a*, 35*b* as measured from the surface of the carriage table 35 is determined to be slightly greater than the total thickness of the stack of the pair of ink ribbon cassettes 40. The pins 35*a* and 35*b* are provided at the upper ends thereof with claws 35*a*-2, 35*b*-2 formed integrally therewith in such a manner as to project towards the hooks 35*c*, 35*d* and 35*e*, in order to retain the upper surface of the upper ink ribbon cassette 40.

The hooks 35*c*, 35*d* and 35*e* are provided at their upper ends with claws 35*c*-2, 35*d*-2 and 35*e*-2 formed integrally therewith so as to project towards the pins 35*a* and 35*b*. The length of the hook 35*c* is about half that of the hooks 35*d*, 35*e* so that the claw 35*c*-2 of the hook 35*c* engages with an engaging portion 42*k* of the lower cassette 40. The claws 35*d*-2 and 35*e*-2 of the hooks 35*d* and 35*e* are capable of engaging with engaging portions 42*l* and 42*m* of the upper cassette.

For setting the ink ribbon cassette 40 which constitutes the lower stage of the stack, the ink ribbon cassette 40 is placed such that the pins 35*a*, 35*b* are received in apertures 41*a*, 41*b*, 42*i* and 42*j* formed in the upper and lower cases of the ink ribbon cassette 40 (see FIGS. 13 and 14), and the claw 35*c*-2 of the upper hook 35*c* is made to resiliently engage with a triangular engaging portion 42*k* of the lower case, whereby the ink ribbon cassette 40 is demountably set on the carriage table 35.

Once the ink ribbon cassette 40 of the lower stage is set as described, this ink ribbon cassette 40 is fixed against movement in all horizontal directions by the pins 35*a*, 35*b* and the hook 35*c*, while the vertical movement of the same is prevented solely by the hook 35*c*. Thus, the vertical movement of the ink ribbon cassette is not perfectly prohibited but, rather, the end of the cassette facing the platen 5 is allowed to move up and down.

The setting of the ink ribbon cassette 40 which constitutes the-upper stage of the stack can be conducted in the same manner. Namely, the pins 35*a*, 35*b* are received in the apertures 41*a*, 41*b*, 42*i*, 42*j* and the claws 35*d*-2, 35*e*-2 of the hooks 35*d* and 35*e* are made to resiliently engage with the engaging portions 42*l* and 42*m*, whereby the ink ribbon cassette 40 of the upper stage is loaded on the carriage table 35 through the intermediary of the ink ribbon cassette 40 of the lower stage.

In this state, the ribbon cassette 40 of the upper stage is prevented from moving in any horizontal direction by the presence of the pins 35*a*, 35*b* and the hooks 35*d*, 35*e*, and is fixed against vertical movement by the claws 35*a*-2, 35*b*-2 of the pins 35*a*, 35*b* and the claws 35*d*-2, 35*e*-2 of the hooks 35*d*,35*e*.

It will be understood that the ink ribbon cassette 40 of the upper stage thus retained effectively fix the stack of the ink ribbon cassettes against movement in all horizontal directions, as well as in the vertical direction.

Figure 1:
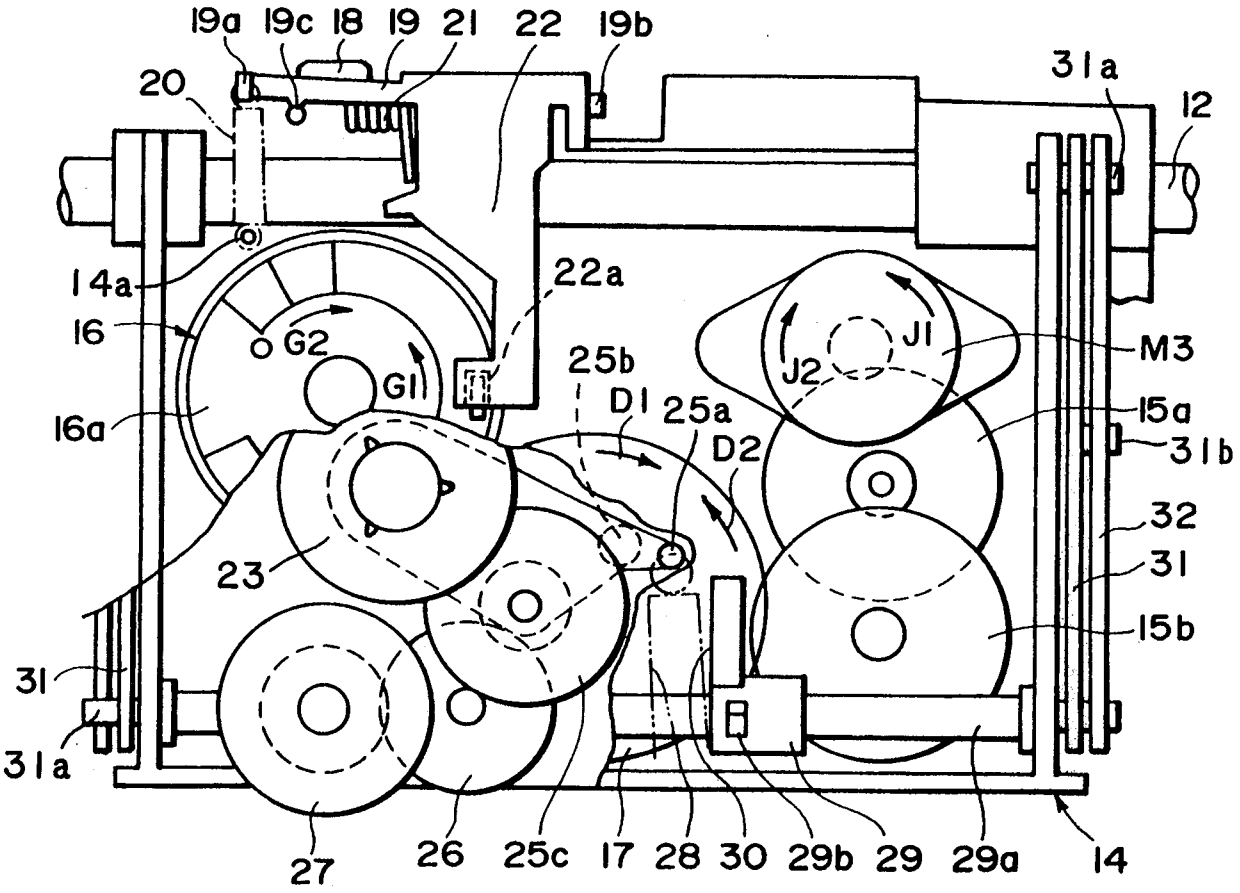
FIG. 1 is a partly-sectioned plan view of a carriage in an image recording apparatus according to the embodiment utilizing the present invention.

A description will be made hereinunder as to the arrangement of parts on the carriage 14. Referring to FIG. 1 showing the whole of the carriage 14, a head motor M3 carried by the carriage 14 drives a head cam 16 and a ribbon cam 17 through reduction gears 15*a* and 15*b*.

The head cam 16 is intended for effecting a head up/down motion for moving the recording head 18 away from and towards the platen 5. The head cam 16 is provided on the upper surface thereof with a cam contour which presents a cam surface 16*a* the lift of which varies in the direction of rotation of the head cam 16. On the other hand, the ribbon cam 17 is intended for controlling a later-mentioned operation for taking up the ribbon, as well as for effecting cassette up/down motion, i.e., operation for effecting switching between different colors of an ink ribbon 50. As will be seen from FIG. 5, the top surface of the ribbon cam 17 is provided with a cassette up/down cam surface 17*a* the lift of which varies in the direction of axis 17*c* of rotation D1, D2 of the ribbon cam 17. On the upper side of the cam surface 17*a* is provided a ribbon take-up cam surface 17*b* the lift of which varies in the direction perpendicular to the axis 17*c* of rotation of the ink ribbon cam 17, i.e., in the radial direction about the axis 17*c* of rotation.

Figure 4:
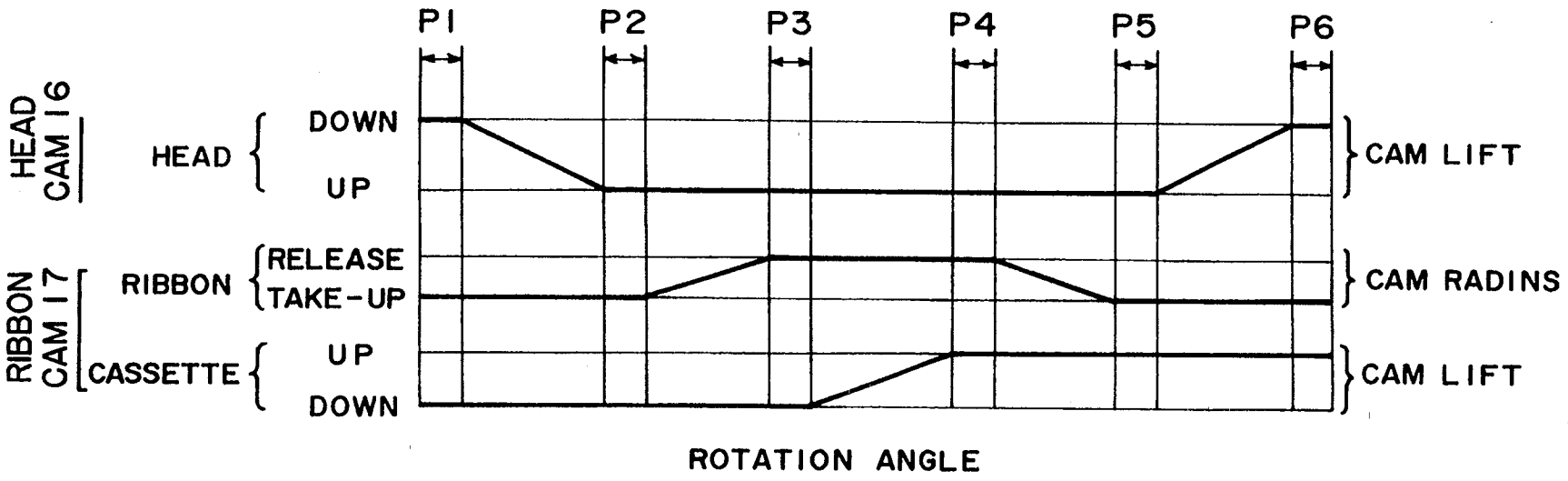
FIG. 4 is a cam chart illustrating the operation of a cam on the carriage shown in FIG. 1.

FIG. 4 is a cam chart illustrating the phases of the head cam 16 and the ribbon cam 17 during operation thereof. As will be seen from this Figure, there are six types of combination of the head up/down operation, ribbon take-up operation and the cassette up/down operation, by suitably selecting the phases of rotation of the head cam 16 and the ribbon cam 17 which are driven by the head motor M3 (see FIG. 1).

The rotational angles of the head cam 16 and the ribbon cam 17 are limited to fall within the ranges shown in the cam chart of FIG. 4, by means of stoppers (not shown) provided on the carriage 14.

More specifically, referring to FIG. 4, the lower portion of the cam surface 16*a* of the head cam 16 is presented throughout positions P2 to P5 so as to realize a later-mentioned head-up state, i.e., a state in which the head is lifted and kept away from the platen, whereas, when in the positions P6 and P1, the head cam 16 presents a higher portion of the cam surface 16*a* so as to realize a head-down state, i.e., a state in which the head 18 has come down to press the platen.

In the positions P1 to P2 and P5 to P6, the portion of the cam surface 17*b* of the ribbon cam 17 having a small radius is presented so as to realize a later-mentioned ribbon take-up state, whereas, in the positions P3 and P4, the greater radius portion of the cam surface 17*b* is presented so as to realize a later-mentioned ribbon take-up dismissing state.

In the positions P1 to P3, the cassette up/down cam surface 17*a* of the ribbon cam 17 presents its lower lift portion so as to realize a later-mentioned cassette-down state in which the cassette of the upper stage is set in the recording position, whereas, in the positions P4 to P6, the cassette up/down cam surface 17*a* of the ribbon cam 17 presents its high lift portion so as to realize a later-mentioned cassette-up state in which the cassette of the lower stage is set in the recording position.

A description will be made hereinunder as to the cassette up-down mechanism which also constitute an ink ribbon change-over means.

Figure 5:
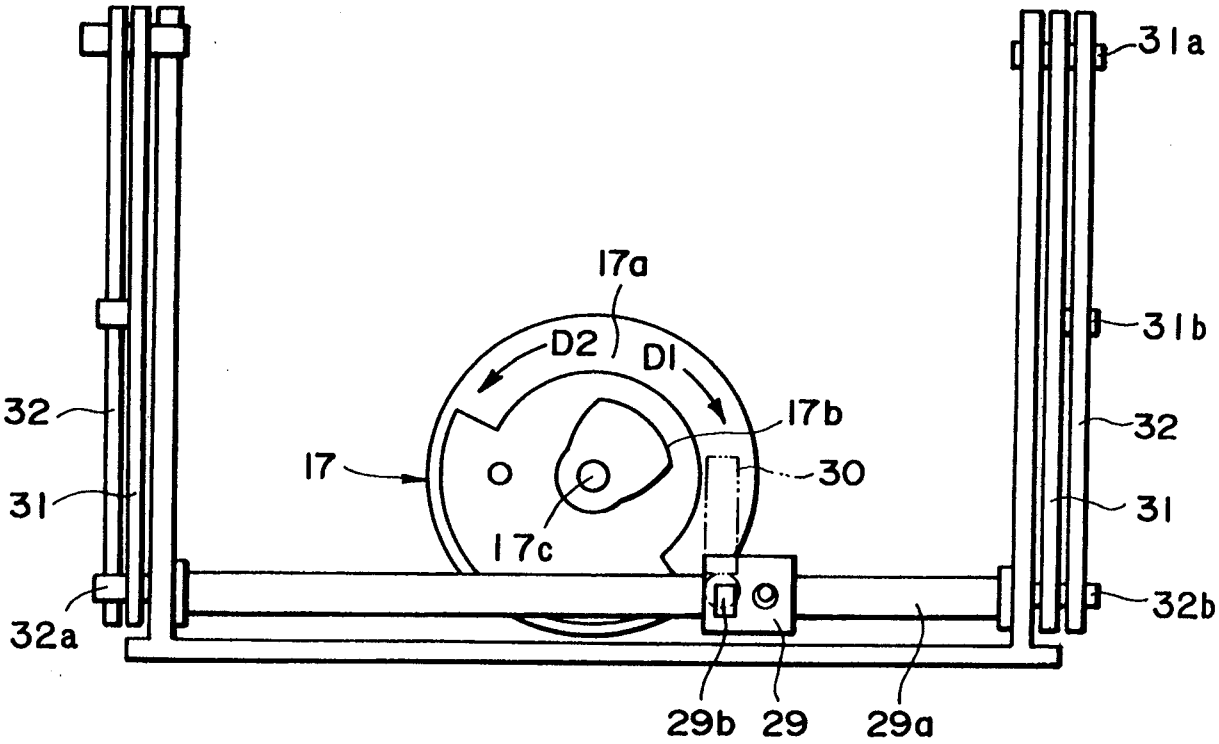
FIG. 5 is a plan view of a cassette up/down mechanism shown in FIG. 1.
Figure 7:
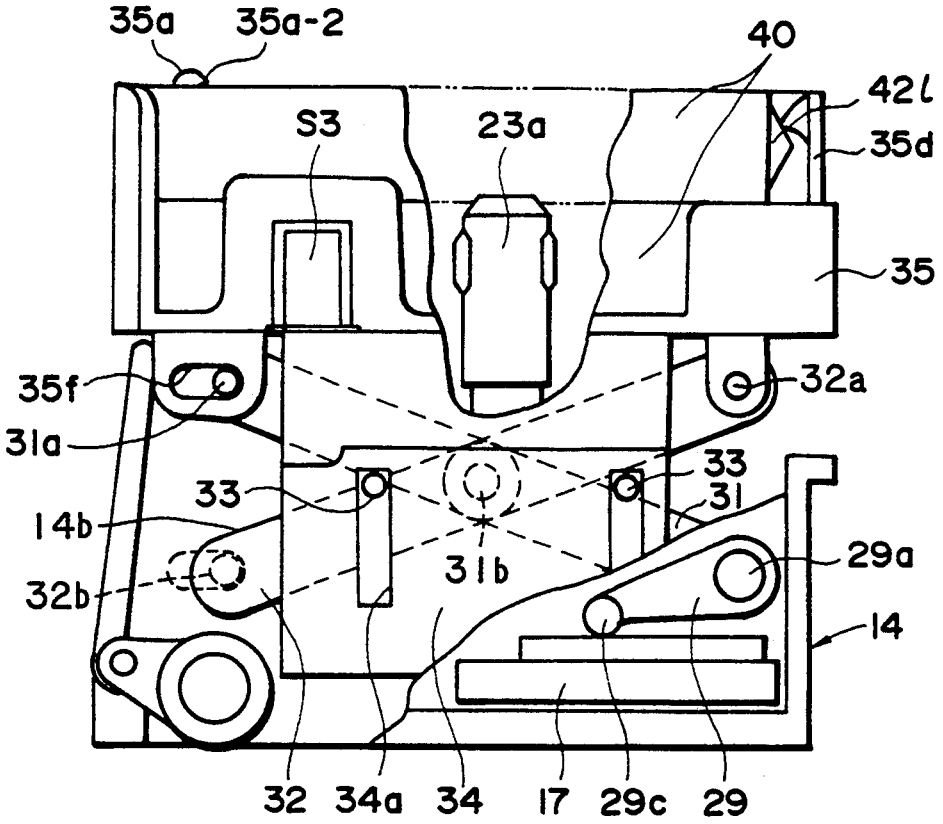
FIG. 7 is a side elevational view of the cassette up/-down mechanism shown in FIG. 5 in a cassette-up state.

FIG. 5 is a plan view of the cassette up/down mechanism. FIGS. 6 and 7 show, respectively, the side elevation of the cassette up/down mechanism in cassette-down and cassette-up states, respectively.

Referring to FIGS. 5, 6 and 7, a cassette shift lever 29, is fixed to a cassette shift shaft 29*a* which is rotatably guided and supported on the carriage 14.

A cassette shift spring 30 is loaded between a lug 29*b* on the cassette shift lever 29 and a lug (not shown) on the carriage 14.

The end 29*c* of the cassette shift lever 29 is urged by the force of the cassette shift spring 30 in the direction indicated by an arrow C2, so that it resiliently contacts the cam surface 17*a* of the ribbon cam 17 (see FIG. 6).

The cassette shift lever 29 is connected through the cassette shift shaft 29*a* to another cassette shift lever 31. The cassette shift lever 31 is provided with a boss 31*b* which rotatably carries still another cassette shift lever 32.

The cassette shift lever 31 is provided at its one end with a boss 31*a*, while the cassette shift lever 32 is provided at its one end with a boss 32*a*. These bosses 31*a* and 32*a* are received in apertures 35*f* and 35*g* formed in the carriage table 35. Another boss 32*b* formed on the other end of the cassette shift lever 32 is received in the aperture 14*b* formed in the carriage 14. With this arrangement, it is possible to maintain the carriage table 35 substantially horizontal.

When the lift presented by the cam surface 17*a* becomes large, the cassette shift lever 29 is rotated clockwise as viewed in FIG. 6 as indicated by an arrow C1, with the result that the cassette shift lever 31 also is rotated clockwise in FIG. 6 as indicated by the same arrow C1.

As will be understood from the foregoing description, the vertical position of the center of rotation of the cassette lever 31, i.e., the cassette shift shaft 29*a* and the boss 32*b* are restricted by the carriage 14 so that the boss 31*a* of the cassette shift lever 31 and the boss 32*b* of the cassette shift lever 32 move within the aperture 35*f* in the carriage table 35 and the aperture 14*b* in the carriage 14, respectively. Thus, the carriage table 35 is moved up and down as indicated by arrows E1 and E2 in FIG. 6, by a pantograph mechanism which converts a rotary motion into a linear motion.

The carriage table 35 is provided with a boss 33 which is received in an aperture 34*a* formed in a carriage cover 34 attached to the carriage 14, whereby the stroke of the vertical movement of the carriage table 35 in the directions of arrows E1 and E2 is limited. That is, the stroke ends of the up/down motion of the carriage table 35 is strictly limited by the engagement between the boss 33 and the upper and lower edges of the aperture 34*a*.

A description will be made hereinunder as to the cassette up/down operation, i.e., the operation for effecting switching between different colors on the ink sheet (or ink ribbon).

FIGS. 5 and 6 illustrate the states of various parts in the cassette-down state, i.e., the state in which the ink ribbon cassette 40 of the upper stage is set at the recording position.

In this state, the ribbon cam 17 is set in a phase corresponding to the positions P1 to P3 in FIG. 4. Namely, the end 29*c* of the cassette shift lever 29 is resiliently pressed onto the small lift portion of the ribbon cam 17*a* of the ribbon cam 17 by the force of the cassette shift spring 30 so that the carriage table 35 is held in the cassette-down position.

Then, as the ribbon cam 17 is rotated clockwise as indicated by an arrow D1 as shown in FIG. 5, the position of contact between the cam surface 17*a* of the ribbon cam 17 and the end 29*c* of the cassette shift lever 29 is progressively raised in the direction perpendicular to the cam surface.

Consequently, the cassette shift lever 29 is rotated clockwise as viewed in FIG. 6 (see arrow C1) against the force of the cassette shift spring 30.

As explained before, the rotation of the cassette lever 29 causes the carriage table 35 to move upward as indicated by the arrow E1 (see FIG. 6). When the lift of the cam surface 17*a* becomes equal to that corresponding to the positions P4 to P6 in FIG. 4, the cassette of the lower stage is set at the recording position, thus accomplishing the cassette-up state as shown in FIG. 7.

A description will be made hereinunder as to the ribbon take-up mechanism, i.e., the ink sheet feeding means.

Figure 8:
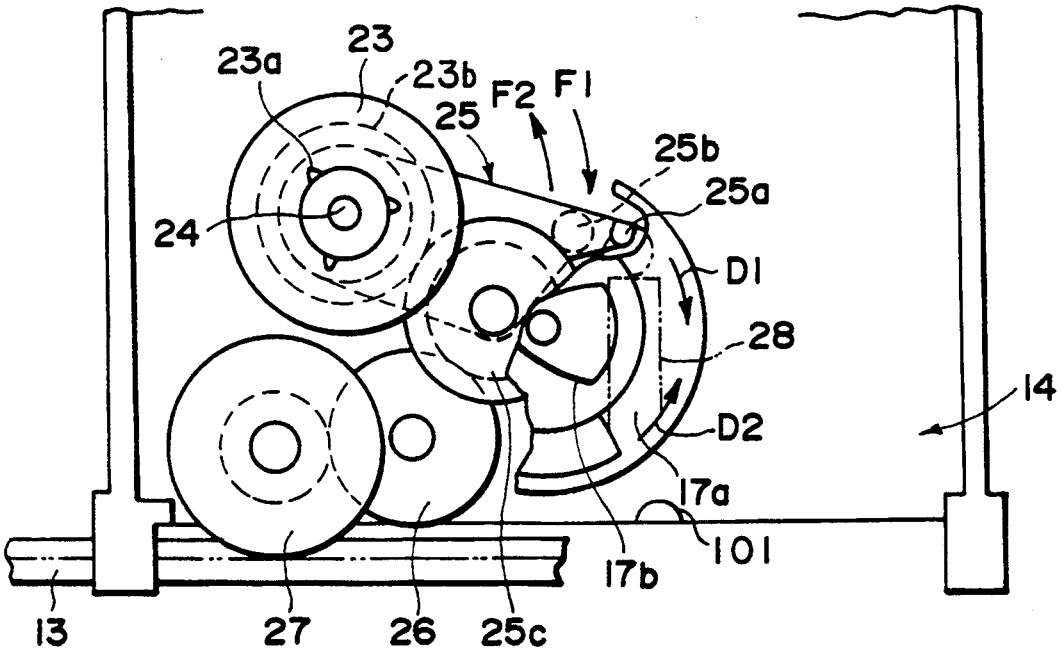
FIG. 8 is a plan view of a ribbon take-up mechanism shown in FIG. 1, illustrating the mechanism in operating condition.
Figure 9:
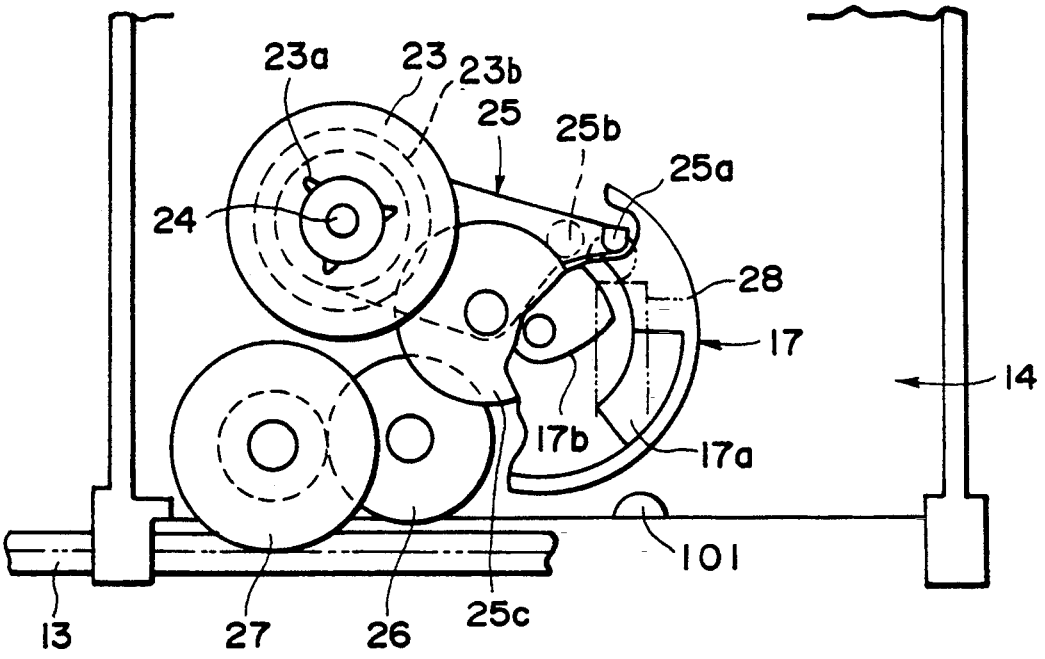
FIG. 9 is a plan view of a ribbon take-up mechanism shown in FIG. 8, illustrating the mechanism in inoperative (releasing) condition.

Referring to FIGS. 8 and 9 which are plan views of the ribbon take-up mechanism in the ribbon take-up state and ribbon take-up dismissing state, respectively, the carriage 14 carries a take-up shaft 24. A take-up lever 25 is supported by the take-up shaft 24 for rotation about the shaft 24. A take-up clutch 23 is rotatably supported by an upper portion of the lever 25.

Furthermore, the take-up lever 25 rotatably supports a take-up reduction gear 25*c*. The reduction gear 25*c* engages with a gear portion 23 *b* of the take-up clutch 23 in such a manner that the gear portion 23*b* of the take-up clutch 23 constitutes a sun gear, while the take-up reduction gear 25*c* constitutes a planet gear.

The carriage 14 also rotatably carries a take-up gear 27 and a take-up intermediate gear 26 meshing therewith. The take-up gear 27 engages with the rack 13 mentioned before.

A take-up lever pressing spring 28 is loaded between a spring retainer portion 25*a* of the take-up lever 25 and a spring retainer portion 101 of the carriage 14, so as to urge the take-up lever 25 in the direction of an arrow F1 (see FIG. 8).

The take-up clutch 23 is provided with a hub-receiving portion 23*a* which can fit in a take-up core 44 (see FIGS. 13 and 14) in the ink ribbon cassette 40.

Furthermore, a friction clutch 23 is provided between the hub receiving portion 23*a* of the take-up clutch 23 and the gear portion 23*b* of the same, so that the torque of the gear portion is transmitted to the hub receiving portion 23*a*.

A description will be made hereinunder as to the operation for taking up or feeding the ink ribbon or sheet.

In the ribbon take-up state as shown in FIG. 8, the ribbon cam 17 is in the state corresponding to the positions P1 to P2 or P5 to P6, so that the take-up lever 25 is urged clockwise (arrow F1) by the take-up lever pressing spring 28, thereby keeping the take-up reduction gear 25*c* on the take-up lever 25 in engagement with the take-up intermediate gear 26.

In this state, as the carriage 14 is moved in the recording direction (i.e., in the direction of an arrow B1 in FIG. 3), the take-up gear 27 is rotated due to its engagement with the rack 13.

The rotation of the take-up gear 27 is transmitted to the take-up clutch 23 through the take-up intermediate gear 26 and the take-up reduction gear 25*c* so as to rotate the hub receiving portion 23*a* of the take-up clutch 23. In consequence, the take-up core 44 in the ink ribbon cassette engaging with the hub receiving portion 23*a* is rotated to take up the ink ribbon 49.

Then, as the ribbon cam 17 is rotated clockwise or counterclockwise (directions of arrow D1 or D2 in FIG. 8), the cam surface 17*b* provided on the ribbon cam 17 and the boss 25*b* provided on one end of the ribbon cam 17 are brought into contact with each other. A further rotation of the ribbon cam 17 increases the radius of the portion of the cam surface 17*b* contacted by the boss 25*b* of the take-up lever 25, in accordance with the cam chart shown in FIG. 4.

Consequently, the take-up lever 25 is rotated counterclockwise (see arrow F2 in FIG. 8) against the force of the take-up lever pressing spring 28. When the cam surface 17*b* rotates to a position corresponding to the positions P3 to P4 in the cam chart shown in FIG. 4, the take-up reduction gear 25*c* guided and supported by the take-up lever 25 comes off the intermediate gear 26.

When the carriage 14 is further moved in the recording direction (arrow B1 in FIG. 3), the take-up gear 27 meshing with the rack 13 is rotated so as to drive the intermediate gear 26. In this case, however, since the take-up reduction gear 25*c* has been disengaged from the intermediate gear 26, the torque of the take-up gear 27 is not transmitted to the reduction gear 25*c*.

This means that the gear portion 23*b* of the take-up clutch 23 meshing with the take-up reduction gear is not rotated. Thus, the ribbon is not taken up in the positions P3 and P4 in FIG. 4.

A description will be made hereinunder as to the head up/down mechanism for driving the thermal head 18 (recording head) up and down.

Figure 10:
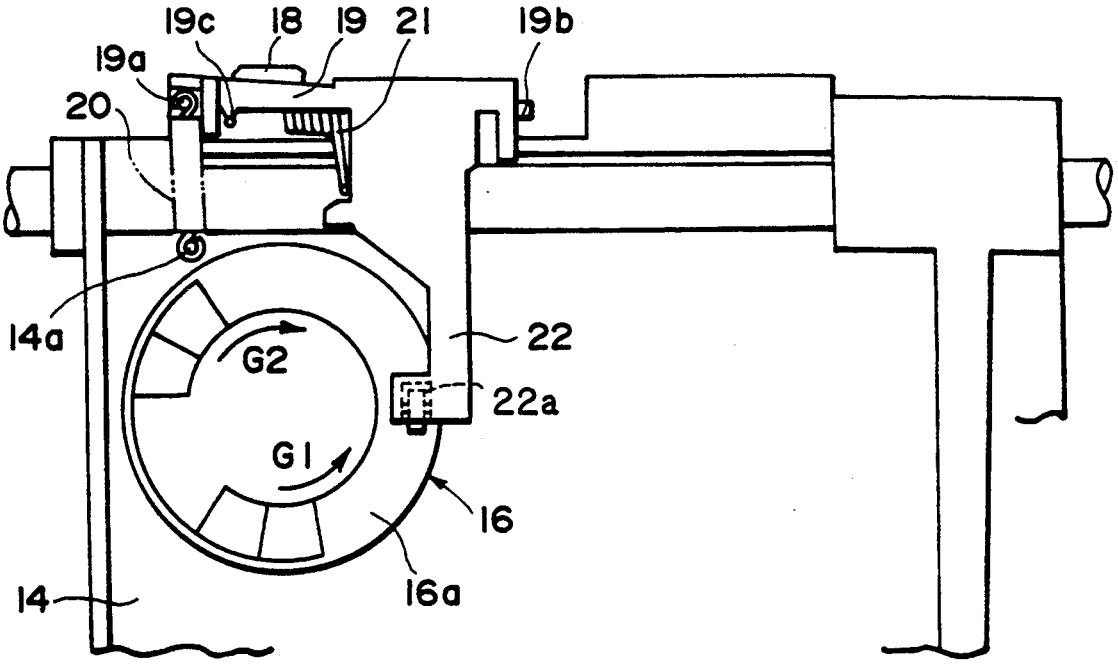
FIG. 10 is a plan view of the head up/down mechanism.
Figure 11:
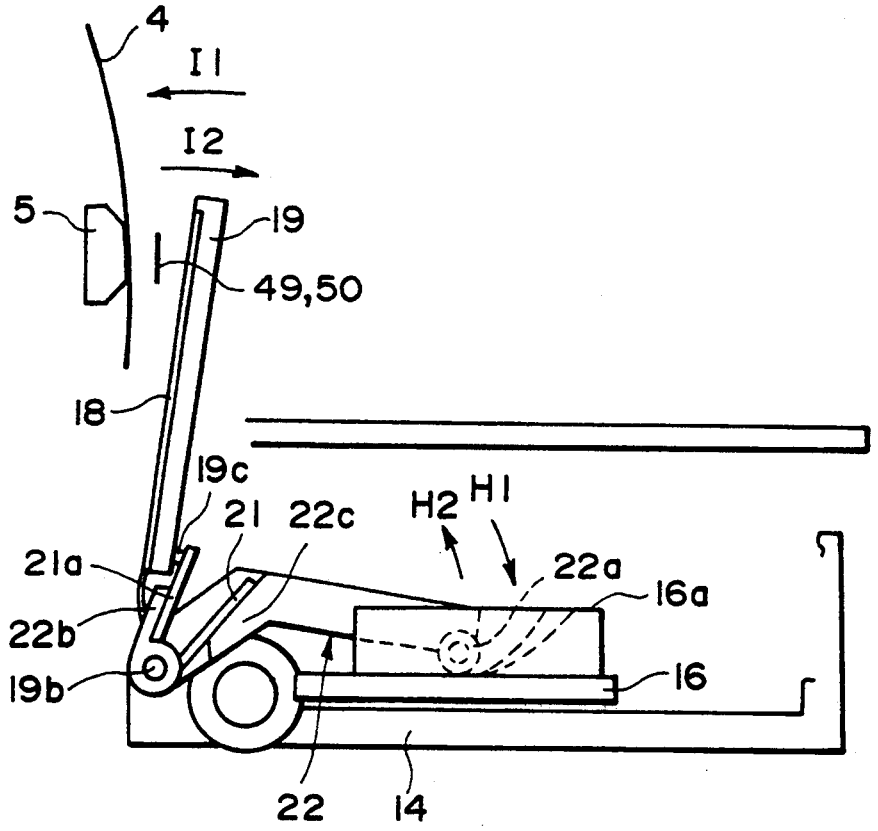
FIG. 11 is a side elevational view of the head up/-down mechanism shown in FIG. 10 in head-up condition.
Figure 12:
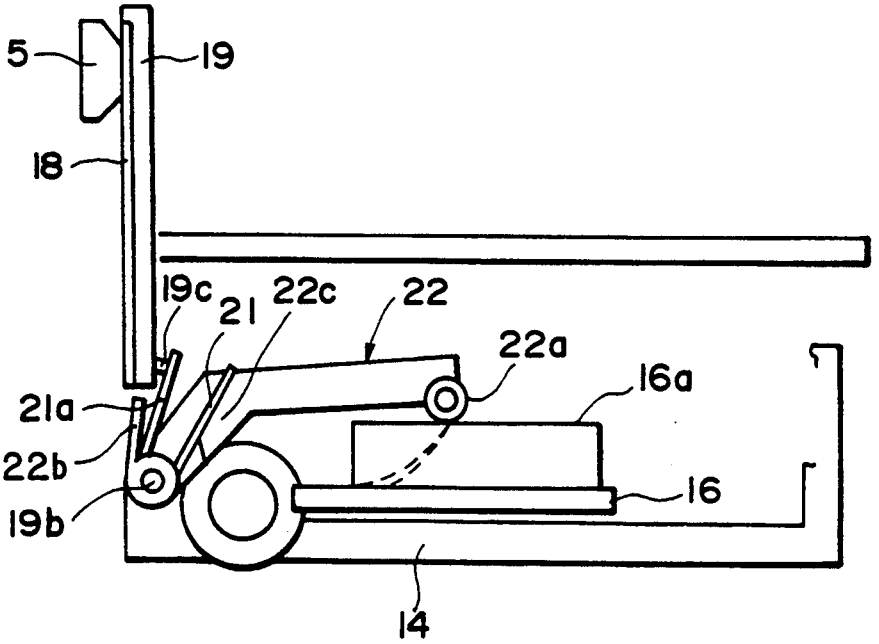
FIG. 12 is a side elevational view of the head up/-down mechanism shown in FIG. 10 in head-down condition.
Figure 13:
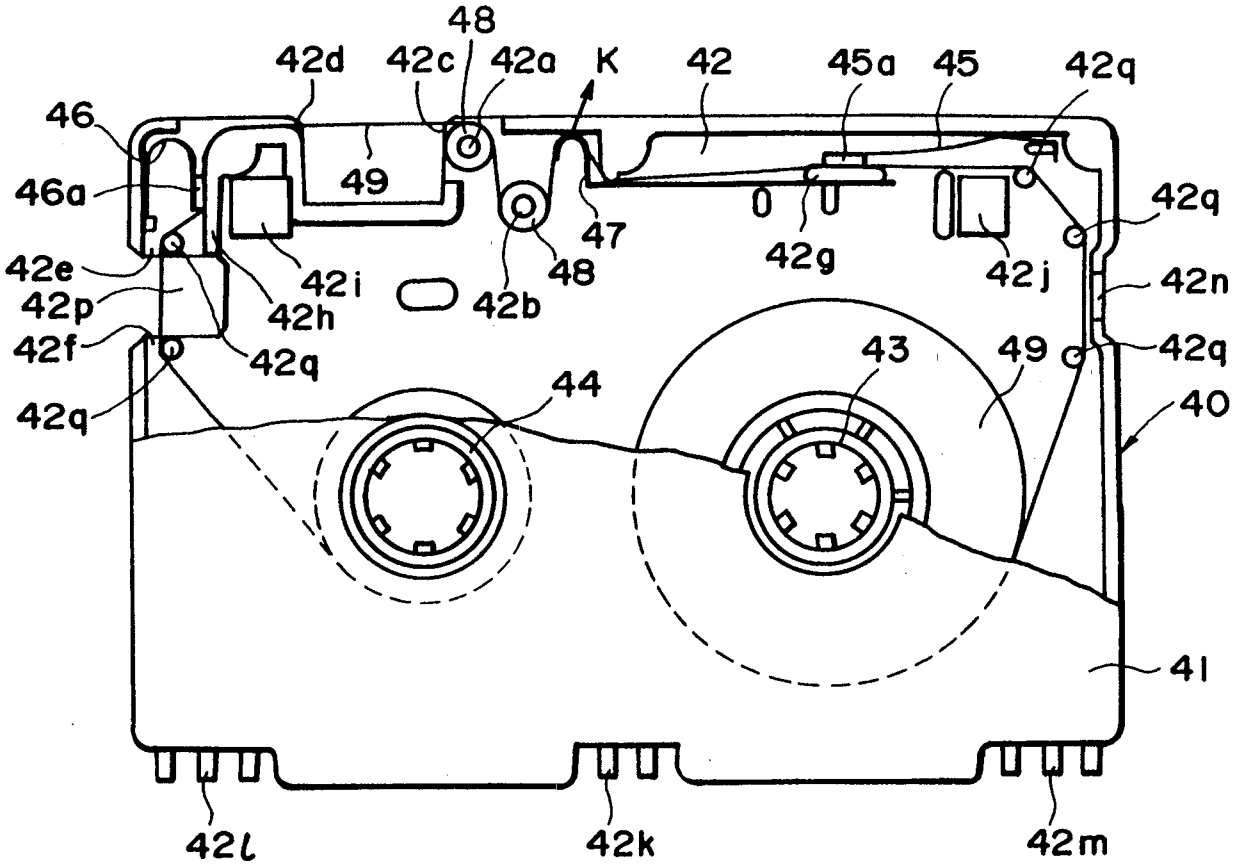
FIG. 13 is a partly-sectioned plan view of an ink ribbon cassette.
Figure 14:
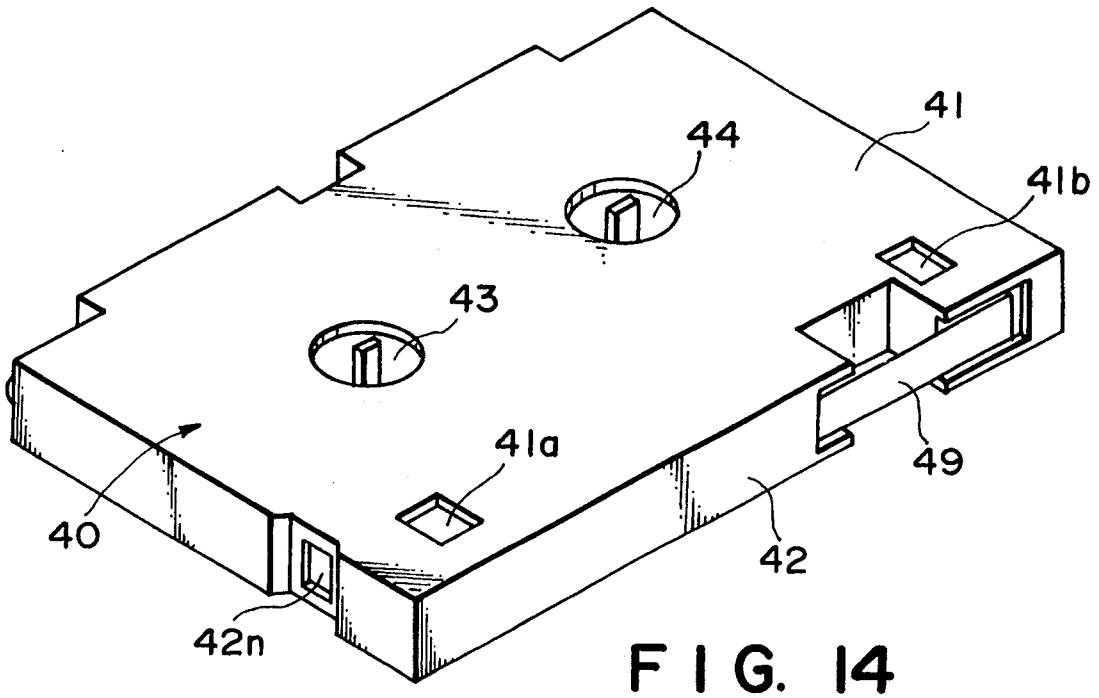
FIG. 14 is a perspective view of the ink ribbon cassette shown in FIG. 13.

FIG. 10 is a plan view of the head up/down mechanism. FIGS. 11 and 12 are side elevational views of the head up/down mechanism in the head-up and head-down states, respectively.

Referring to these Figures, a head up/down lever 22 is mounted for rotation about a head holder shaft 19*b* provided on the carriage 14. A head spring 21 is charged between projection 22*b* and 22*c* of the head up/down lever 22.

A roller 22*a* is rotatably guided and supported by one end of the head up/down lever 22. A head reset spring 20 is provided between a spring retainer portion 19*a* of the head holder 19 and a spring retainer portion 14*a* of the carriage 14, so as to urge the head holder 19 away from the platen 5, as indicated by an arrow I2 in FIG. 11.

The urging force produced by the head reset spring 20 is transmitted to an arm portion 21*a* of the head spring 21 through a pressing portion 19*c* of the head holder 19, and further to the head up/down lever 22 through the arm portion 21*a*. Thus, the head up/down lever 22 is urged away from the platen 5 by the force of the head reset spring 20 as indicated by arrow I2 in FIG. 11, whereby the roller 22*a* provided on the up/-down lever 22 is held in pressure contact with the cam surface 16*a*.

In consequence, the head 18 is swung towards the platen 5 as a result of a change in the lift of the head cam 16.

The head-down and head-up operations for pressing the recording head onto the platen 5 and for moving the same away from the platen B are conducted in a manner which will be explained hereinunder.

Referring to FIGS. 10 and 11, when the head cam 16 is in a state corresponding to the positions P2 through P5 in the cam chart shown in FIG. 4, the head up/down lever 22 is held in pressure contact with the head cam 16 by the force of a head reset spring 20 so that the head 18 is kept away from the recording sheet 4 and the platen 5. Thus, the recording head is held in the head-up state.

Then, as the head cam 16 is rotated clockwise as indicated by an arrow G2 in FIG. 10 or clockwise as indicated by an arrow G1 in the same Figure, the height of the position of contact between the cam 16 and the roller 22*a* on the head up/down lever 22 as viewed in the direction perpendicular to the cam surface is increased.

As a result, the head up/down lever 22 is rotated counterclockwise as indicated by an arrow H2 in FIG. 11, against the force of the head reset spring 20. The torque of the head up/down lever 22 is transmitted from the arm portion 21*a* of the head spring 21 to the pressing portion 19*c* of the head holder 19 so as to cause the head holder 19 to rotate counterclockwise (see arrow I1 in FIG. 11). In consequence, the thermal head 18 adhered to the head holder 19 is pressed onto the platen 5 through the recording ink sheet 4 and one of the ink ribbons 49 and 50 (see FIG. 11).

Thus, the thermal head 18 is held in contact with the recording sheet 4 during the recording and the recording sheet 4 is held At the instant position by the platen 5.

The lift of the head cam 16 continues to increase even after the thermal head 18 is brought into contact with the platen 5 through the recording sheet 4 and the ink ribbon, so that the head up/down lever 22 is further rotated counterclockwise (arrow H2 in FIG. 11).

Thus, when the rotational position of the head cam 16 corresponding to the positions P1 and P6 in the cam chart of FIG. 4 is reached, the motion of the head holder 19 is limited by the abutment of the thermal head 18 with the platen 5 through the recording sheet 4 and the ink ribbon.

Therefore, the further counterclockwise rotation (see arrow H2 in FIG. 11) of the head up/down lever 22 causes the head spring 21 to leave the projection 22*b* on the head up/down lever 22, whereby the head spring 21 is further charged up.

Since the arm portion 21*a* of the head spring 21 is separated from the projection 22*b* of the head up/down lever 22, the force of the head spring 21 is transmitted to the pressing portion 19*c* of the head holder 19, so that the thermal head 18 is pressed onto the platen 5 through the recording sheet 4.

A description will be made hereinunder as to the total operation including the head up/down operation, ribbon take-up operation and the cassette up/down operation, with reference to the cam chart shown in FIG. 4, at each of the positions P1 to P6.

Referring to FIG. 4, the position P1 is a position of the cams where the recording head is in the head-down state, the ribbon take-up mechanism is in the ribbon take-up state and the cassette is in the cassette-down position. Thus, the position P1 corresponds to a state in which the recording is conducted with the ink ribbon cassette of the upper stage of the stack. The position P2 is a position of the cams where the recording head is in the head-up state, the ribbon take-up mechanism is in the ribbon take-up state and the cassette is in the cassette-down state. Thus, the position P2 corresponds to a state in which the ribbon in the upper stage cassette is taken up while the recording is not conducted.

The position P3 is the position of the cams which simultaneously establishes the head-up state, ribbon take-up dismissing state and the cassette-down state, while the position P4 is the position of the cams where the head-up state, ribbon take-up dismissing state and the cassette-up state. Thus, in the position P4, the ink ribbon cassette of the lower stage of the stack is in the operative position.

The position P5 is the position of the cams which simultaneously realizes the head-up state, ribbon take-up state and the cassette-up state. Thus, in this position, the ribbon in the cassette of the lower stage of the stack is taken up while the recording is suspended.

Finally, the position P6 is the position of the cams which simultaneously achieves the head-down state, ribbon take-up state and the cassette-up state. Thus, recording is conducted with the ink ribbon in the cassette of the lower stage when the cams are in the position P6.

It is thus possible to freely and independently attain one of the six conditions, namely, the recording state, non-recording state, ribbon take-up dismissing state, ribbon take-up state, cassette-up state and the cassette-down state, by operating the head motor M3 (see FIG. 1) either clockwise or counterclockwise so as to rotate the head cam 16 and the ribbon cam 17 to one of the six positions P1 to P6.

It is not essential that the above-mentioned six conditions are controlled independently. For instance, the state of the ribbon take-up mechanism may be conducted in a certain synchronized relation to the head-up and head-down operation. It is also possible to effect three types of operations, i.e., the head up/down operation, the switching of the states of the ribbon take-up mechanism and the cassette up/down operation independently A description will be made hereinunder as to the ink ribbon cassette with reference to FIG. 13 which is a plan view of the cassette and FIG. 14 which is a perspective view of the same.

Referring to these Figures, the ink ribbon cassette 40 has an upper case 41 and a lower case 42, and is adapted to be demountably loaded on the carriage table 35 while accommodating an ink ribbon 49 therein.

The trailing portion of the ink ribbon 49 is wound on a supply core 43. The leading portion of the ink ribbon 49 is led past guide pins 42*q* and rollers 48 rotatably mounted on projections 42*a*, 42*b* of the lower case 42, so as to be exposed through an opening 42*c* formed in the lower case 42. The ink ribbon 49 is then led again into the cassette 40 through an opening 42*d* in the lower cassette 42 and is exposed again through an opening 42*e* formed in the lower case 42. The ink ribbon is then led into the cassette 40 through an opening 42*f* in the lower case so as to be taken-up by the take-up core 44 past a guide pin 42*q*.

When the cassette 40 is loaded correctly on the carriage table 35, the exposed portion of the ink ribbon 49 between the openings 42*c* and 42*d* is positioned such as to face the recording head 18 on the carriage 14 so that this portion of the ink ribbon 49 is selectively heated by the thermal head 18 which generates heat in accordance with recording information. The ink ribbon 49 is urged onto projections 42*g*, 42*h* of the lower case 42 by means of pressing springs 45, 46 which are provided on the lower case 42. Pieces of felt 45*a*, 46*a* are adhered to the pressing springs 45, 46 so as to prevent any damage on the ink ribbon 49 which may otherwise be caused due to contact with the pressing springs 45, 46.

A tension spring 47 serves to urge the ink ribbon 49 in the direction of an arrow K (see FIG. 13) so as to cooperate with the pressing springs 45, 46 in eliminating any slack of the ink ribbon 49.

A portion of the ink ribbon 49 is exposed through an opening 42*n* in the lower case 42. When the cassette 40 is loaded in the right position on the carriage table 35, the opening 42*n* in the lower case 42 is positioned to face a ribbon sensor S2 which is provided on the carriage 14 and capable of sensing "ribbon end", i.e., the terminal end of the ink ribbon. At the same time, the exposed portion of the ink ribbon 49 between the openings 42*e* and 42*f* is opposed by a color sensor S3 which is provided on the main part and which is received in a notch 42P.

A description will be made hereinunder as to a multi-color ribbon with specific reference to FIG. 15.

Figure 15:
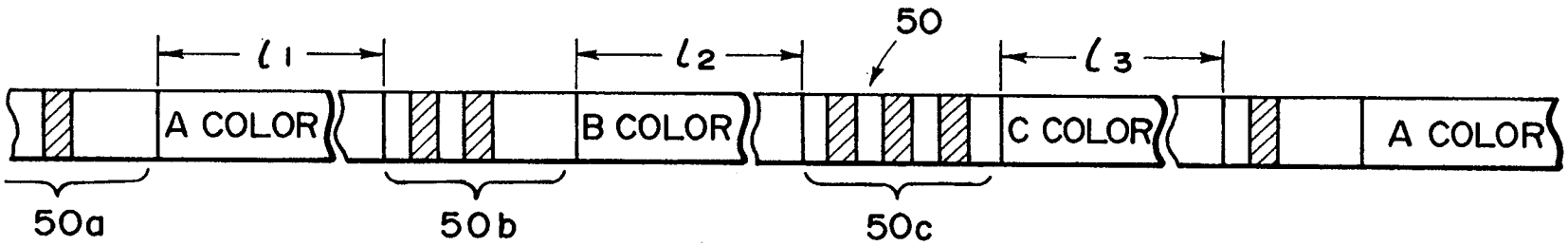
FIG. 15 is an illustration of the construction of a multi-ink ribbon.

FIG. 15 shows an example of the multi-color ribbon 50 on which are provided successive regions of different colors having widths $1_1$, $1_2$, and $1_3$, which are assumed to be color A, color B and color C, with bar codes 50*a*, 50*b* and 50*c* between adjacent regions. The multi-color ribbon 50 also is stored in the ink ribbon cassette 40 as is the case of the ink ribbon 49.

When the ribbon cassette 40 is placed in the right position on the carriage table 35, the color sensor S3 (see FIG. 3) of the main part opposes the exposed portion of the multi-color ribbon 50 between the apertures 42*e* and 42*f* of the lower case 42.

When the multi-color ribbon is taken up onto the take-up core 44, the bar codes 50*a*, 50*b* and 50*c* are sensed by the color sensor S3 whereby the color which follows the sensed bar code is detected. As will be seen from FIG. 15, the bar codes may be constituted by different number of black stripes or black stripes of different width. Thus, any suitable type of bar codes can be used. The number of colors also may be varied though a tri-color ink ribbon is specifically mentioned.

Figure 16:
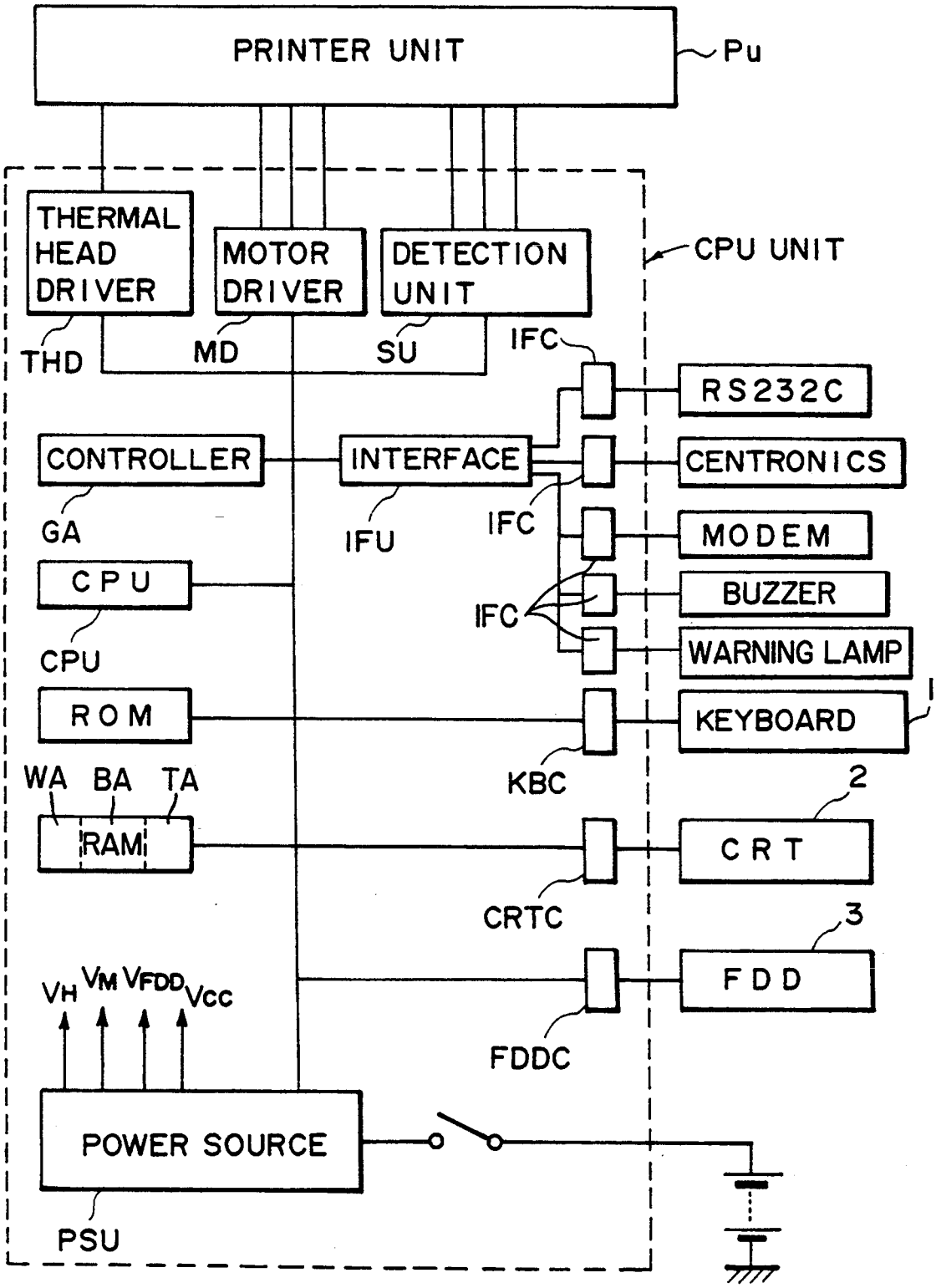
FIG. 16 is a block diagram of a control system for controlling the operation of the image recording apparatus according to the embodiment utilizing the present invention.

FIG. 16 is a block diagram of the recording apparatus described above. This block diagram shows only the connections between related blocks, while minute control lines are omitted.

The apparatus has a central processing unit CPU which reads various data from later-mentioned read-only memory ROM and floppy disk drive FDD and performs various computations and judgments, as well as various types of control. The CPU may be constituted by a plurality of units.

The read-only memory ROM stores various data such as various programs for the CPU operation, dot patterns (character generator CG), and data necessary for printing.

A read/write memory RAM has a working area WA for temporarily storing data appointed by the CPU and the result of computation performed by the CPU, a buffer area BA for storing various data input through the keyboard 1, external interface IFU, floppy disk drive FDD 3 and so forth, and a text area TA for storing a document.

The CPU unit is connected to the printer unit Pu through a thermal head driver THD, motor driver MD and a detection sensor unit SU.

The thermal head driver THD is adapted for driving the thermal head 18 on the printer unit Pu under the control of the CPU, while the motor driver MD drives the sheet feed motor M1, carriage motor M2 and the head motor M3, under the control of the CPU.

The detection unit SU is adapted to transmit various signals from the home position sensor S1, ribbon sensor S2 and the color sensor S3 which are on the printer unit Pu to the CPU.

The power supply PSU supplies driving power VH for powering the thermal head 8 and recording sheet feed motor M1, driving power VM for driving the carriage motor M2 and the head motor M3, driving power VFDD for driving the floppy-disk drive FDD 3 and power Vcc for various logic circuits.

The controller GA conducts various controls under the control of the CPU, such as control of the printing data transfer to the thermal head 18, control of variation of the voltage and current of the driving power VH, variation of the heat time and duty, and so forth.

A keyboard 1 for inputting various data necessary for the printing is connected to the CPU unit through the keyboard connector KBC.

A CRT 2 for displaying various data input through the keyboard 1 is connected to the CPU through a CRT connector CRTC. The CRT 2 may be substituted by other types of display device such as a liquid crystal display.

Furthermore, a floppy-disk drive FDD 3 is connected to the CPU unit through an FDD connector FDDC. It is possible to use a hard disk, an internal RAM or an external RAM in place of the FDD 3.

It is possible to connect an external interface through an interface connector IFC for the purpose of control of this apparatus by an external controller or for the purpose of communication with an external device. Examples of such an interface are an RS232C, Centronics interface and a MODEM.

As shown in FIG. 16, the recording apparatus may be provided with an acoustic output device such as a buzzer.

Figure 17:
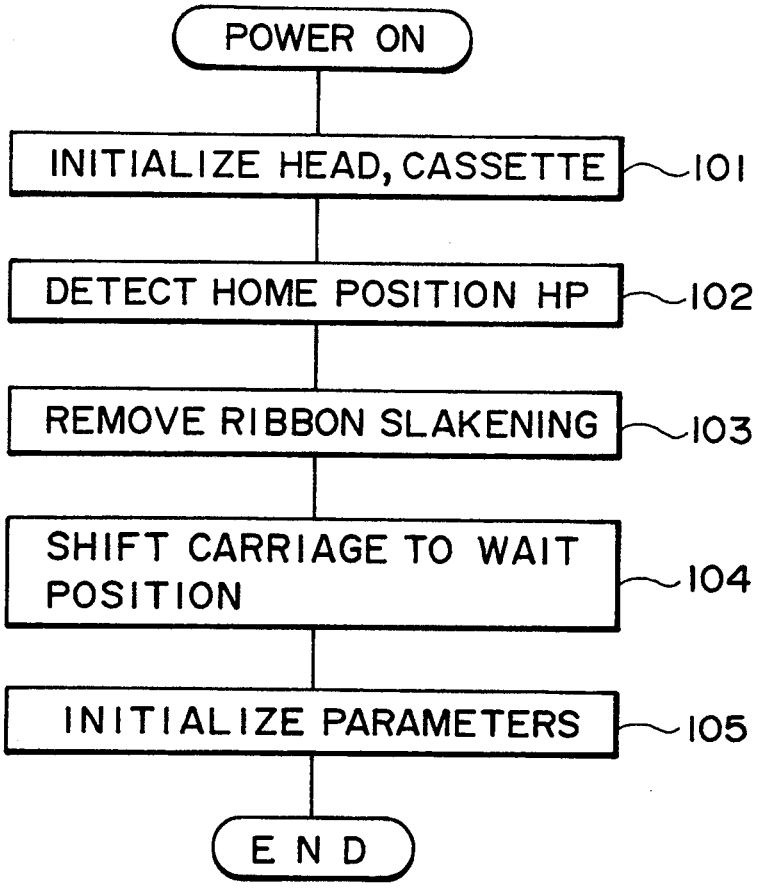
FIG. 17 is a flow chart illustrating the power-on process in the operation of the image recording apparatus shown in FIG. 16.

FIG. 17 is a flow chart illustrating the control operation for controlling the power-on process of the recording apparatus embodying the present invention. A description will be made hereinunder as to the manner in which the recording apparatus is controlled in accordance with programs stored in the ROM or FDD, with specific reference to FIG. 17.

As will be understood from the foregoing description, the recording apparatus can be loaded with at least with two ink ribbon cassettes. Thus, monochromatic printing and multi-color printing can be performed by using an ink ribbon cassette, having a monochromatic ink ribbon and an ink ribbon cassette having a multi-color ink ribbon 50.

Referring to FIG. 17, as the power supply of the apparatus is turned on, an operation is conducted in Step 101 for initializing the head and the cassette. This is effected by raising the thermal head 18 (head-up) while shifting the carriage table 35 down (cassette-down operation) so as to set the ink ribbon cassette of the upper stage in the printing position. The detail of initialization of the head and cassette will be described later.

In Step 102, the carriage motor M2 is driven to shift the carriage 14 towards the home position sensor S1 (see FIG. 1) and is stopped when the carriage 14 is sensed by the home position sensor S1, thus determining the absolute position of the carriage 14.

Subsequently, in Step 103, any slack of the ribbon is taken up so as to avoid any interference between the ribbon and a recording sheet 4 during setting of the recording sheet 4. The detail of the operation for taking up the slack will be explained later.

Subsequently, in Step 104, the carriage 14 is shifted to a stand-by position.

Finally, initialization of various parameters is conducted in Step 105. Namely, the multi-color ribbon set color (MRS) is set at (not decided), while the multi-color ribbon remaining amount (MRL) is set at "0" (zero). The multi-color ribbon set color (MRS) and the multi-color ribbon remaining amount (MRL) will be described later.

Figure 18:
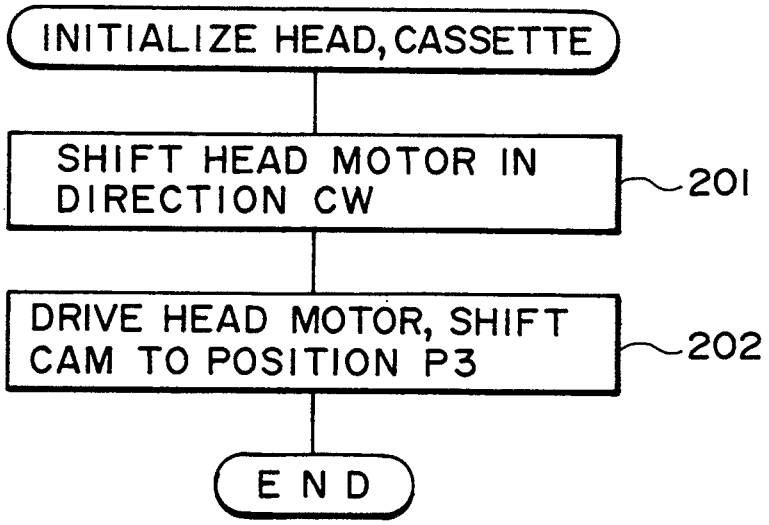
FIG. 18 is a flow chart illustrating the process for initializing the positions of the thermal head and the cassette shown in FIG. 17.

FIG. 18 is a flow chart showing the process for initializing the cassette position. Referring to this Figure the head motor is shifted in clockwise direction in step 201 and, the head motor M3 is driven in the direction of an arrow J1 (see FIG. 1) so as to rotate the head cam 16 (see FIG. 1) and the ribbon cam 17 (see FIG. 1) until they are stopped by the stopper in step 202.

The rotational position of the cams at the moment when the power supply is turned on is indefinite. It is, however, possible to initialize the positions of the head cam 16 and the ribbon cam 17 by allowing these cams to be stopped by the stopper in the clockwise direction by the driving the head motor M3 through an angle which is greater than the full range of rotation of the cam.

Then, in Step 202, the head motor M3 is driven by a predetermined amount in the direction of the arrow J2 (see FIG. 1), thus setting the head cam 16 and the ribbon cam 17 at the cam position P3 in the cam chart shown in FIG. 4.

Therefore, as stated before, the thermal head 18 is lifted away from the platen 5 (head-up operation) while the function for taking up the ribbon is dismissed. On the other hand, the carriage table 35 is shifted down (cassette-down operation), thereby to set the cassette of the upper stage at the recording position.

Figure 19:
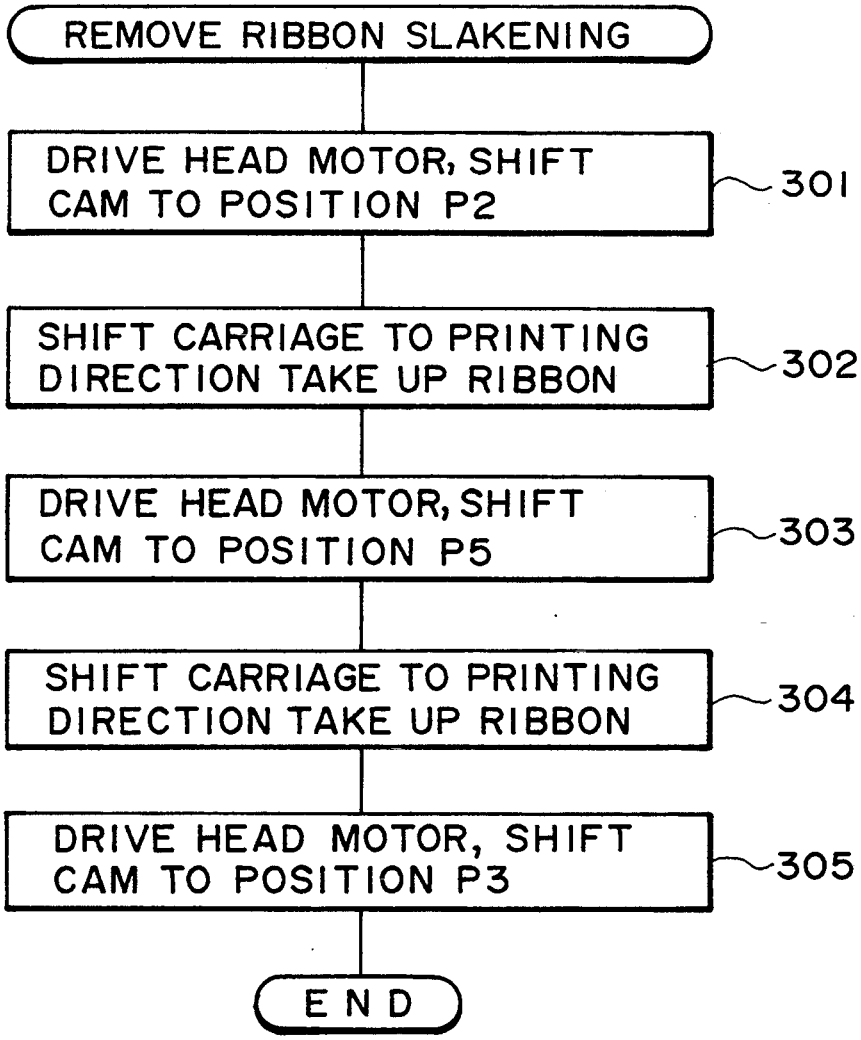
FIG. 19 is a flow chart illustrating a process for taking up slack of the ink ribbon.

FIG. 19 is a flow chart illustrating the process for taking up any slack of the ribbon.

Referring to this Figure, in Step 301, the head motor M3 is started to rotate the head cam 16 and the ribbon cam 17 to the position P2 shown in the cam chart in FIG. 4. Subsequently, in Step 302, the carriage motor M2 is driven to shift the carriage 14 in the printing direction.

As explained before, the shifting of the carriage 14 in the printing direction while the cams are in the position P2 causes the take-up clutch 23 to rotate, whereby the ink ribbon in the cassette of the upper stage is taken up.

Subsequently, in Step 303, the head motor M3 is driven to bring the head cam 16 and the ribbon cam 17 to the position P5 shown in the cam chart in FIG. 4. As a result, the cassette of the lower stage is shifted to a position where the printing is conducted with the ink ribbon in this cassette, while the take-up core in the cassette of the lower stage is brought into engagement with the take-up clutch 23.

Subsequently, in Step 304, the carriage motor M2 operates to shift the carriage 14 in the printing direction. As explained before, the shifting of the carriage 14 in the printing direction while the cams are in the position P5 causes the take-up clutch 23 to rotate,whereby the ink ribbon in the cassette of the lower stage is taken up to eliminate the slack.

In Step 305, the head motor M3 is driven so as to rotate the head cam 16 and the ribbon cam 17 to the cam position P3 shown in FIG. 4, thus completing the process.

The described sequence of the operation for taking up slack of the ink ribbon is only illustrative, and the take-up of the slack also can be conducted by executing Steps 303, 304, 301, 302 and 305 in the mentioned order. The amount of shift of the carriage 14 for taking up slack of the ink ribbon must be minimized because a large amount of shift of the carriage causes the ink ribbon to be taken up excessively, resulting in in a wasteful consumption of the ink ribbon.

Figure 20:
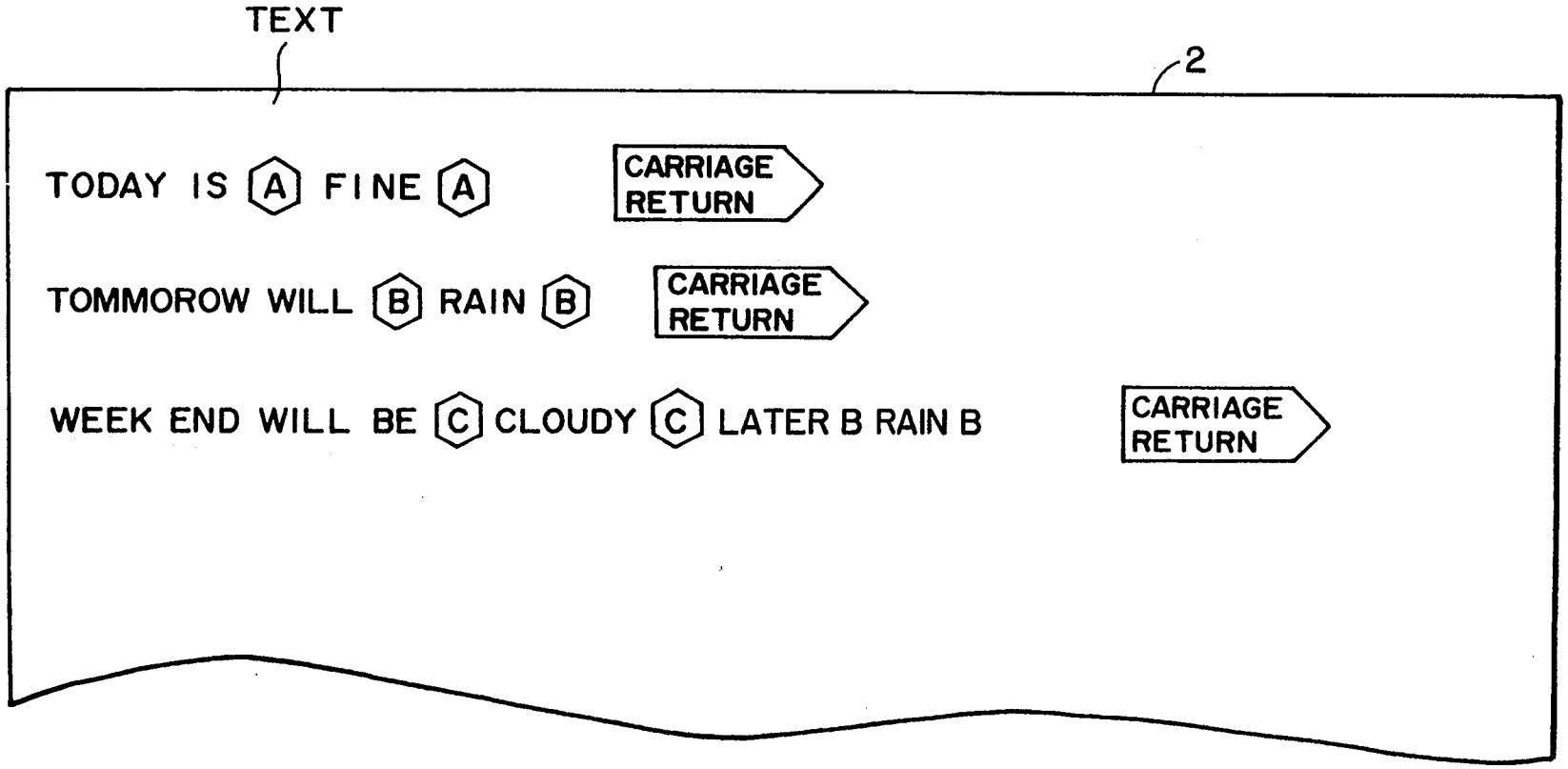
FIG. 20 is an illustration of an example of a process for appointing one of the colors in a text.

FIG. 20 illustrates an example of a process for designating a color in which a specific portion of a text is to be printed. The designation is conducted by demarcating the region to be printed in this color, and inputting an instruction for designating the desired color by a color designating key 1A-1. The keyboard 1 can have a plurality of color designating keys 1A corresponding to different colors, or the designation of color may be effected by a suitable combination of keys such as a combination of single color key and one of a plurality of numeral keys 1C corresponding to different colors, or a combination of a function key 1B and one of alphabetic keys 1D, e.g., c, corresponding to different colors.

The demarcation of the region in the text may be conducted by placing a specific character at the beginning and tail ends of the region as shown in FIG. 20, or the characters in the region may be displayed in a bold form. When a color display device such as a color CRT or a color LCD is used as the display device, the demarcation of the region of the text to be printed in a specific color is most conveniently and efficiently displayed by the same color as the printing color, so that this region can easily be recognized.

When a monochromatic CRT or a monochromatic LCD is used as the display device, it is rather difficult to discriminate the demarcated region. In such a case, therefore, it is advisable to adopt such a function that the demarcated region can be intensified or made to blink in accordance with a key operation, thus facilitating the recognition of the demarcated region.

A description will be made hereinunder as to a printing menu for setting various parameters in the printing, with specific reference to FIGS. 21(*a*) and 21(*b*) which illustrate an example of the operation for appointing a color with such a printing menu.

Figure 21A:
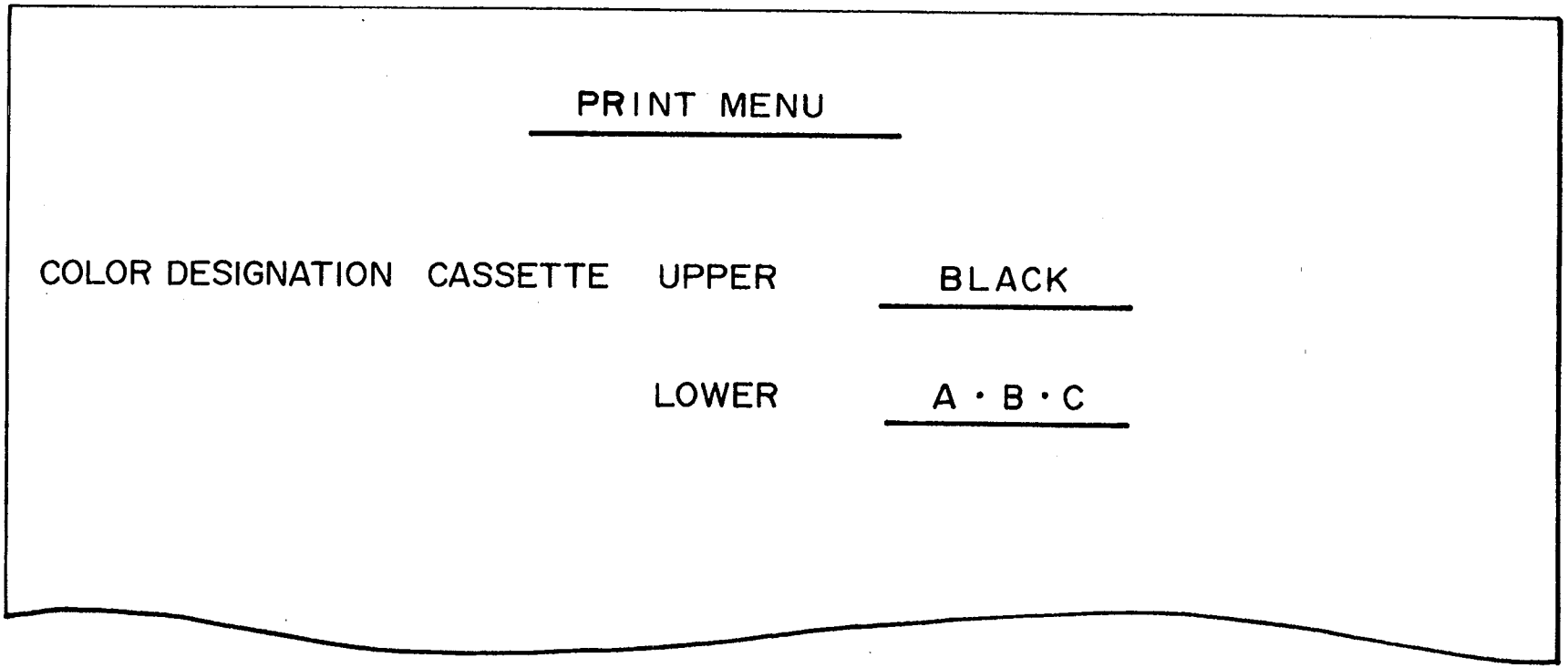
FIGS. 21(*a*) and 21(*b*) are illustrations of a print menu for setting various parameters.
Figure 21B:
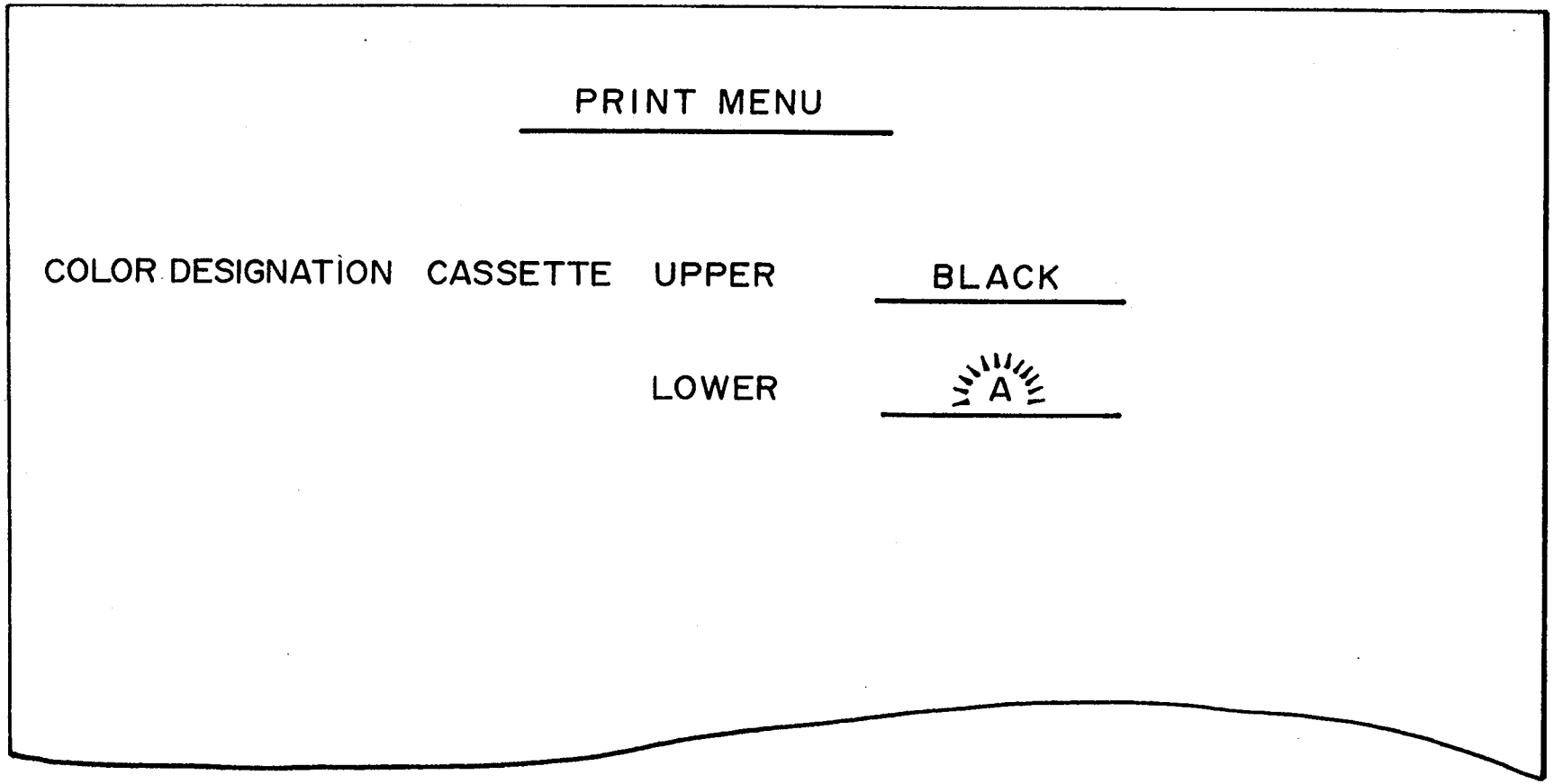

The color of the cassette ink ribbon is designated as shown in FIG. 21(*a*) in accordance with the color designation in the text as shown in FIG. 20. When the color designation actually conducted does not conform with the color designation in the text, e.g., as shown in FIG. 21(*a*), the operator can be warned by a blink of the portion which does not conform with the color designation in the text, or by means of a buzzer, as shown in FIG. 16.

When the operator dares to execute the printing neglecting the warning, the printing is effected in accordance with the color designation set in the menu, rather than the color designation in the text.

It is therefore possible to easily alter the color designation simply by setting the desired color designation in the printing menu, without requiring alteration of the color designation in the text. For instance, it is possible to effect a monochromatic (black or red) printing of a text which has been demarcated for multi-color printing, or to print in blue color the portion of the text which has been designated for printing in red.

Although a color designation on the displayed printing menu has been specifically described, the input means 1, 2 or 3 for effecting color designation may be effected on any area on the display other than the text or, alternatively, may be effected by input means other than that on the display, e.g., a specific key 1A-1 on the keyboard 1, a specific switch 1E or a series of key operations. Thus, the printing in desired color is possible by effecting the color designation of the cassette at the portion other than the text.

Figure 22A:
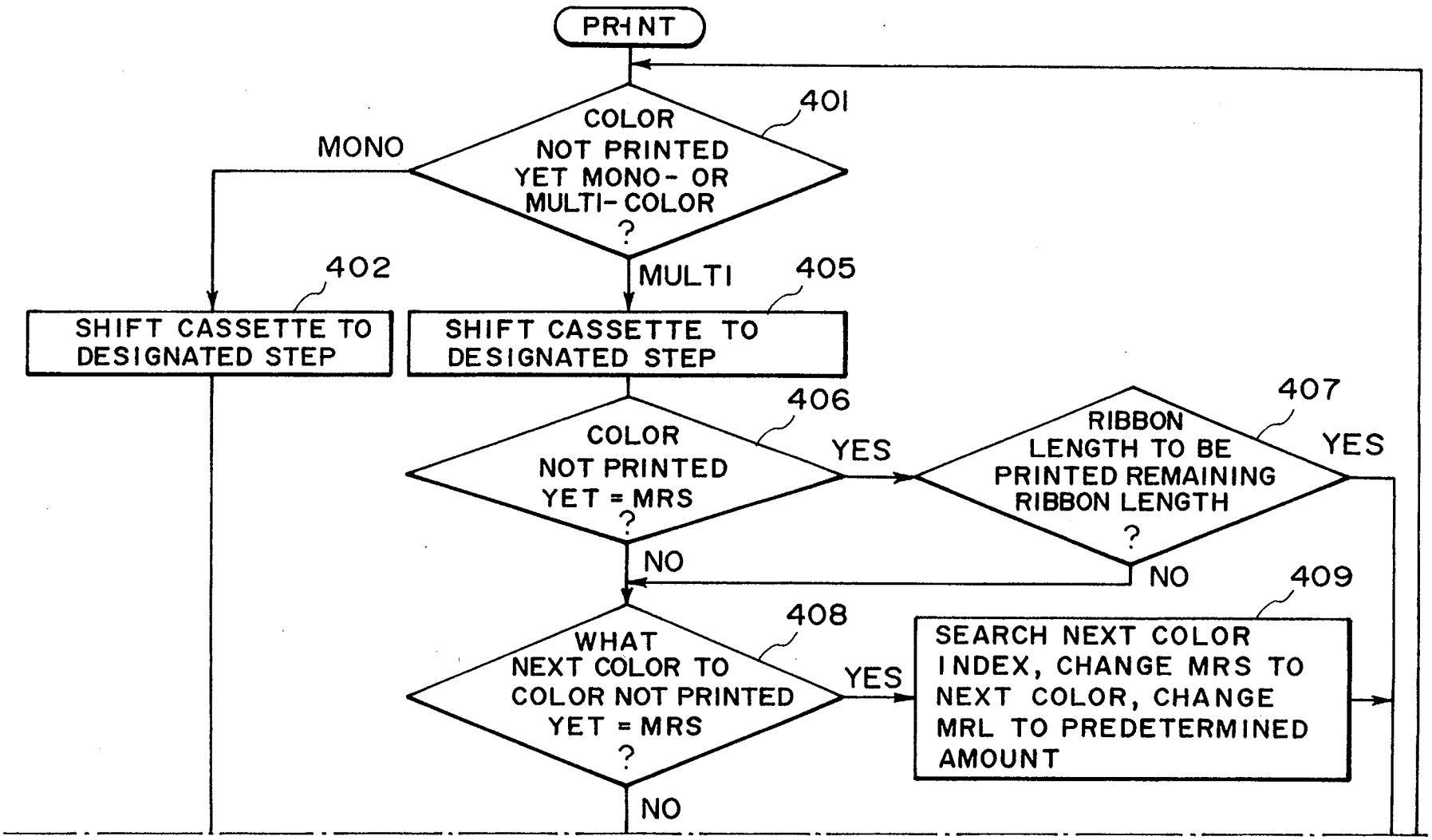
FIG. 22A and 22B are together a flowchart of an image recording sequence performed by the image recording apparatus according to the embodiment utilizing present invention.
Figures 22, 22A, 22B:
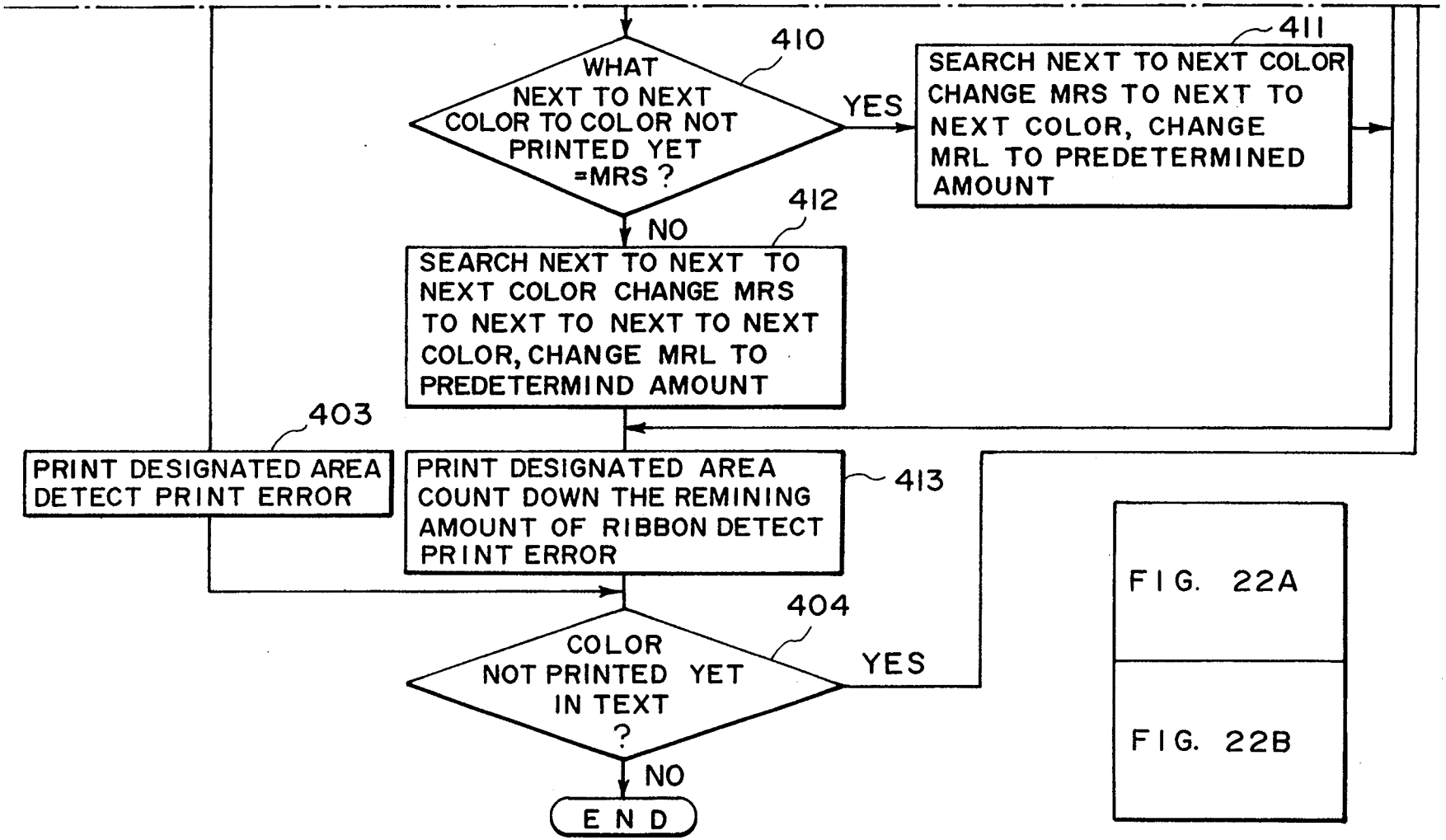
FIG. 22 shows the relative location of FIGS. 22A and 22B.

FIGS. 22A and 22B together form a flow chart showing the printing sequence. A description will be made hereinunder with specific reference to FIG. 22A and 22B as to the operation for executing printing of the text formed as shown in FIG. 20, in accordance with the color designation in the printing menu as shown, for example, in FIG. 21(*a*).

Referring to FIG. 22A, in Step 401, a judgment is conducted as to whether the color which has been designated in the printing menu and which has not been printed yet is a monochromatic color or a multi-color.

When this color is a monochromatic color, or when this color includes both monochromatic and multi-color, the process proceeds to Step 402, whereas, when the color is multi-color, the process proceeds to Step 405.

In Step 402, the cassettes are shifted to bring the cassette of the designated color to the printing position. Namely, when the printing is to be done with the ink ribbon in the ink ribbon cassette of the upper stage, the head motor M3 operates to shift the cams to the position P3 shown in FIG. 4, whereas, when the printing is to be made with the ink ribbon in the cassette of the lower stage, the cams are shifted to the position P4 shown in FIG. 4. The process then proceeds to Step 403 in which the carriage motor M2 is started so as to move the carriage 14 to the designated printing position, and the head motor M3 is driven to shift the head cam 16 and the ribbon cam 17 to the printing position. More specifically, the head cam 16 and the ribbon cam 17 are shifted to the cam position P1 in FIG. 4 when the printing is to be done with the ink ribbon in the ink ribbon cassette of the upper stage, whereas, when the printing is to be conducted with the ink ribbon in the ink ribbon cassette of the lower stage, the cams are shifted to the cam position P6 in FIG. 4. Thereafter, the thermal head 18 is pressed against the platen 5 through the ink ribbon and the recording sheet 4. In this state,the heat-generating resistance elements 18*a* on the thermal head 18 are selectively energized by the thermal head driver THD in accordance with the recording information, while moving the carriage 14. In consequence, the heat-fusible ink applied to the ink ribbon is fused to be transferred to the recording sheet 4, thus printing the demarcated region of the text while the ink ribbon is taken up.

The detail of error detection conducted in Step 403 will be described later.

After executing the printing of the designated region in Step 403, the carriage 14 is stopped and the thermal head 18 is set up (head-up operation) followed by dismissal of the ribbon take-up function. The process then proceeds to Step 404.

As stated before, when the color not printed is judged to be a multi-color in the question posed in Step 401, the process proceeds to Step 405 in which the cassette-up/down operation is conducted to bring the ink ribbon cassette having the designated multi-color ink ribbon to the printing position.

The process then proceeds to Step 406 in which a judgment is conducted as to whether the multi-color to be printed includes the present multi-color ribbon set color (MRS).

If the answer is YES, i.e., if the present multi-color ribbon set color (MRS) is included in the multi-color to be printed, the process proceeds to Step 407, whereas, if the answer is NO, the process proceeds to Step 408.

For instance, when the MRS is the color A, a judgment is conducted in Step 406 as to whether or not the color A is included in the multi-color to be printed.

The searching of the color index on the multi-color ribbon is not conducted in the period immediately after the turning on of the power supply. In addition, the multi-color ribbon set color (MRS) is set as being "not decided" in Step 105 of the power-on sequence which was described before in connection with FIG. 17. In this case, therefore, the process proceeds to Step 408.

In Step 407 mentioned above, a judgment is conducted as to whether the length of the multi-color ribbon to be consumed by the printing of the designated region of the text is smaller than the length of remaining portion of the multi-color ribbon. In such a case, the process proceeds to Step 413 so as to start the printing.

If the answer to the question posed in Step 407 is NO, i.e., if the length of the multi-color ribbon to be consumed by the printing of the designated region of the text is greater than the length of remaining portion of the multi-color ribbon, the printing will result in that the ink ribbon will be fed beyond the length of the ribbon region of the designated color. In such a case, therefore, the printing is not conducted and the process proceeds to Step 408.

In Step 408, a judgment is conducted as to whether the color next to the multi-color ribbon set color (MRS) is included in the multi-color to be printed. For instance, when the MRS is the color A, a judgment is conducted as to whether or not the color B is included in the multi-color to be printed. If the answer is YES, the process proceeds to Step 409, whereas, if the answer is NO, the process proceeds to Step 410.

In Step 409, an operation is performed to search for the index of the next color, e.g., the color B. This searching operation will be described later in more detail. In Step 409, however, it is to be noted that the multi-color ribbon set color (MRS) is changed to the next color, e.g., the color B, while the multi-color ribbon remaining length (MRL) is altered to a predetermined amount m. Thereafter, the process proceeds to Step 413, so that printing is executed in the next color, e.g., the color B.

The multi-color ribbon remaining length MRL is determined in accordance with the length l of the ink ribbon as illustrated in FIG. 15.

In Step 410, a judgment is conducted as to whether the color which is next to the next to the present multi-color ribbon set color (MRS) exists in the multi-color to be printed. For instance, when the MRS is the color A, a judgment is conducted as to whether or not the color C is included in the multi-color to be printed. If the answer is YES, the process proceeds to Step 411, whereas, if the answer is NO, the process proceeds to Step 412.

In Step 411, an operation is performed to search for the index of the next to the next color, e.g., the color C. In this Step 411, the multi-color ribbon set color (MRS) is changed to the next to the next color, e.g., the color C, while the multi-color ribbon remaining length (MRL) is altered to m. Thereafter, the process proceeds to Step 413, so that printing is executed in the next to the next color, e.g., the color C.

In Step 412, an operation is performed to search for the index of the next to the next to the next color, e.g., the color A. In this Step 411, the multi-color ribbon set color (MRS) is changed to the next to the next to the next color, e.g., the color A, while the multi-color ribbon remaining length (MRL) is altered to m. Thereafter, the process proceeds to Step 413, so that printing is executed in the next to the next to the next color, e.g., the color A.

In Step 413, the portion of the designated region of the same color as the multi-color ribbon set color (MRS) is printed. Namely, the carriage motor M2 is driven to move the carriage 14 to the designated printing position-and the head motor M3 is operated to effect the head-down operation so as to set the thermal head 18 down, while the ribbon take-up function is put into effect. Then, while the carriage 14 is being moved, the heat-generating resistance elements on the thermal head 18 are selectively energized by the thermal head driver THD in accordance with the printing information,-thereby to selectively melt the heat-fusible ink on the ink ribbon so that the ink is selectively transferred to the recording sheet 4, while the ink ribbon is being taken up, thus printing the above-mentioned portion of the designated region of the text in the desired color.

The error detecting operation conducted in Step 413 will be explained later.

After the printing of the designated region of the text, the carriage 14 is made to stop and the thermal head 18 is set up (head-up operation), while the ribbon take-up function is dismissed. Then, the length of the multi-color ribbon consumed in the printing is subtracted from the multi-color ribbon remaining length (MRL). Thereafter, the process proceeds to Step 404.

In Step 404, a judgment is conducted as to whether there is any color which has not been printed yet, i.e., any color which is to be printed next. If there is any color, i.e., if the answer is YES, the process returns to Step 401. Conversely, if the answer is NO, the printing process is finished. Thus, the present invention enables an efficient use of the multi-color-ink ribbon, by virtue of elimination of the wasteful take-up of the same.

According to the invention, it is possible to further economize the multi-color ribbon by storing information concerning the color and the region which have not been printed yet, and then executing the following process.

In the sequence shown in the flow chart of FIGS. 22A and 22B, the process proceeds from Step 407 to Step 408, if the judgment in Step 407 has shown that the length of the multi-color ink ribbon to be consumed in the printing of the designated region is greater than the remaining length of the multi-color ribbon, i.e., when the answer is NO. This, however, is not exclusive and the sequence may be modified such that the printing is executed to completely consume the remaining length of the multi-color ribbon while counting down the remaining length in accordance with the consumption so as to stop the printing when the remaining length has been reduced to zero, the process being then advanced to Step 408.

The operation in Step 404 may be modified such that judgment is conducted as to whether there is any color which has not been printed yet, as well as any region of the text which has not been printed yet. If there is no color nor region to be printed next, the printing process is finished, whereas, if there is any, the process returns to Step 401.

In consequence, the multi-color-ink ribbon is always used in the state that there is no remaining length in each color region, whereby the efficiency of the ribbon consumption is further improved as compared to the process explained before in connection with the flow chart shown in FIGS. 22A and 22B.

Figure 23:
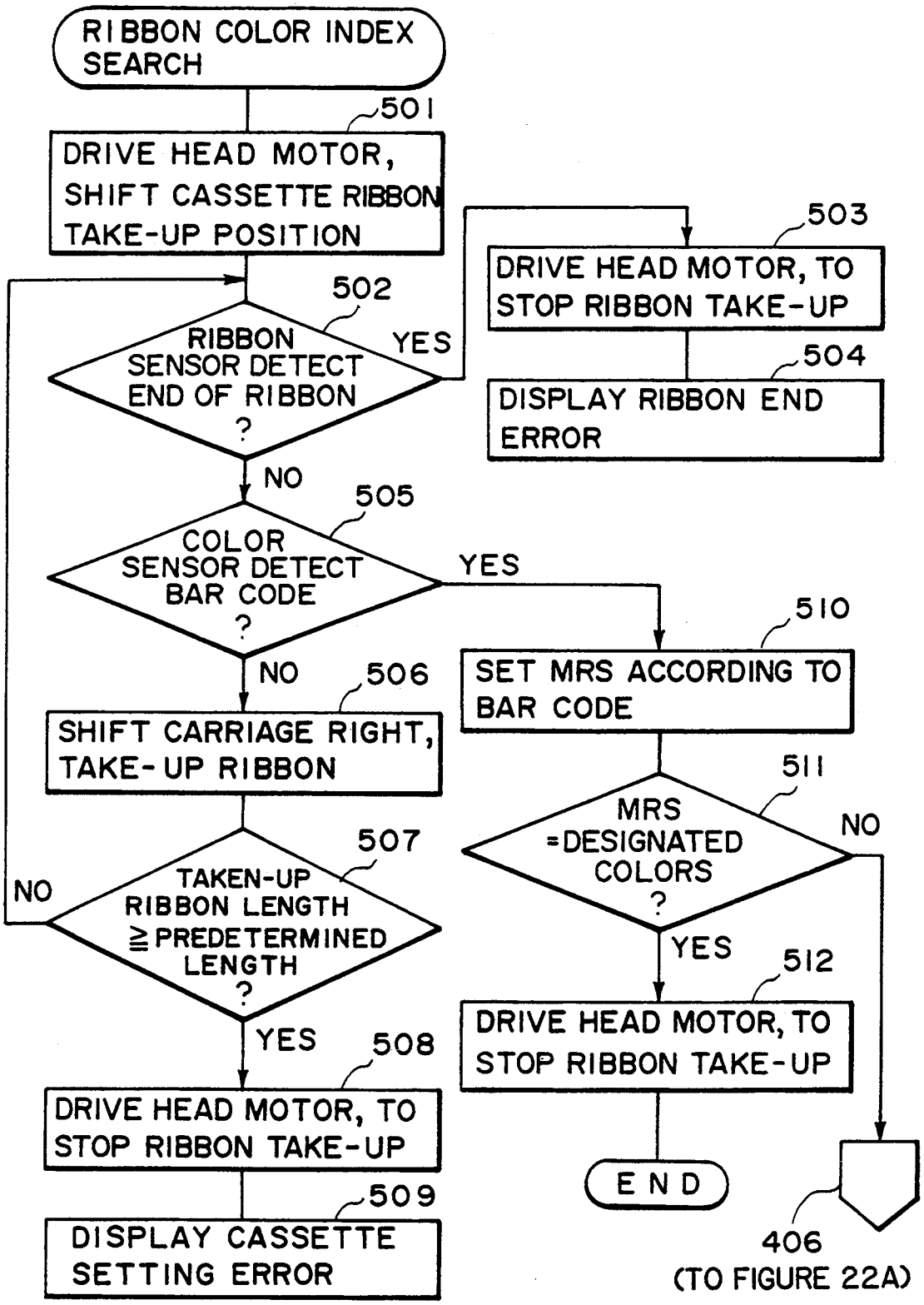
FIG. 23 is a flow chart illustrating a process for searching the color index of the desired color.

A description will be made hereinunder as to the operation for searching the color index of the designated color on the multi-color ribbon which has successive regions of different colors, with reference to FIG. 23 showing a flow chart of a process for searching the color index of the desired color. The searching is actually executed by detecting the bar code portions 50*a*, 50*b* and 50*c* on the multi-color ribbon 50 by means of the color sensor S3, in a manner which will be explained hereinunder.

Referring to FIG. 23, the head motor M3 is driven in Step 501 so as to put the ribbon take-up function into effect. Namely, the cams are shifted to the position P2 in the cam chart of FIG. 4 when the cassette of the upper stage has been selected (cassette-down state), whereas, when the cassette of the lower stage has been selected (cassette-up state), the cams are shifted to the position P5 in the cam chart of FIG. 4.

Then, in Step 502, a judgment is conducted in accordance with the signal from the ribbon sensor S2 capable of detecting ribbon-end state, as to whether the present state is not the ribbon-end state. In case of the ribbon-end state, the process proceeds to Step 503 in which the head motor M3 operates to dismiss the ribbon take-up function. Namely, the cams are shifted to the cam position P3 or P4 in the cam chart of FIG. 4, and then the process proceeds to Step 504 in which a display is conducted to inform the operator of the ribbon-end state.

In Step 502, if the present state is not the ribbon-end state,the process proceeds to Step 505 in which a judgment is conducted as to whether a bar code has been detected by the color sensor S3.

If the answer is NO, i.e., if no bar code has been detected, the process proceeds to Step 506 in which a carriage motor M2 is driven so as to shift the carriage 14 in the recording direction,i.e., to the right, thereby taking up the multi-color ink ribbon 50. The process then proceeds to Step 507 in which a judgment is conducted as to whether the length of the ribbon taken up has exceeded a predetermined take-up length e(see FIG. 15). If the length l has not been exceeded, the process returns to Step 502 in which the color sensing operation is continued while the ribbon is taken up.

In Step 507, if the answer is YES, i.e., if the length l has been exceeded, the presently used ink ribbon is judged as being a monochromatic ink ribbon 49 rather than a multi-color ink ribbon 50. In this case, therefore, the process proceeds to Step 508 in which the head motor M3 is driven to shift the cams to the position for dismissing the ribbon take-up function. Then, the process proceeds to Step 509 in which a display is conducted to inform the operator of the cassette selection error.

In Step 505, if the answer is YES, i.e., if the bar code is detected by the color sensor S3, the process proceeds to Step 510 in which the multi-color ribbon set color (MRS) is set in the color corresponding to the bar code.

Subsequently, in Step 511, a judgment is executed as to whether the MRS is the designated color which is to be searched. If the answer is NO, the process returns to Step 406 shown in FIG. 22. This operation is conducted for the purpose of initializing the process because there is no means for detecting what color will be brought to the printing position when the searching operation is conducted in the state in which the MRS has not been definitely decided immediately after the turning on of the power supply.

If the answer to the question posed in Step 511 is YES, the process proceeds to Step 512 in which the head motor M3 is driven to shift the cams to the position where the ribbon take-up function is dismissed, thus completing the searching of the designated color.

It will be understood that, according to the invention, it is possible to efficiently search the designated color on the multi-color ink ribbon by minimizing the wasteful feed of the ribbon. Furthermore, it is possible to detect any error in the setting of the ink ribbon cassette, e.g., setting of the cassette having the ribbon of a color which is different from the designated color.

Figure 24:
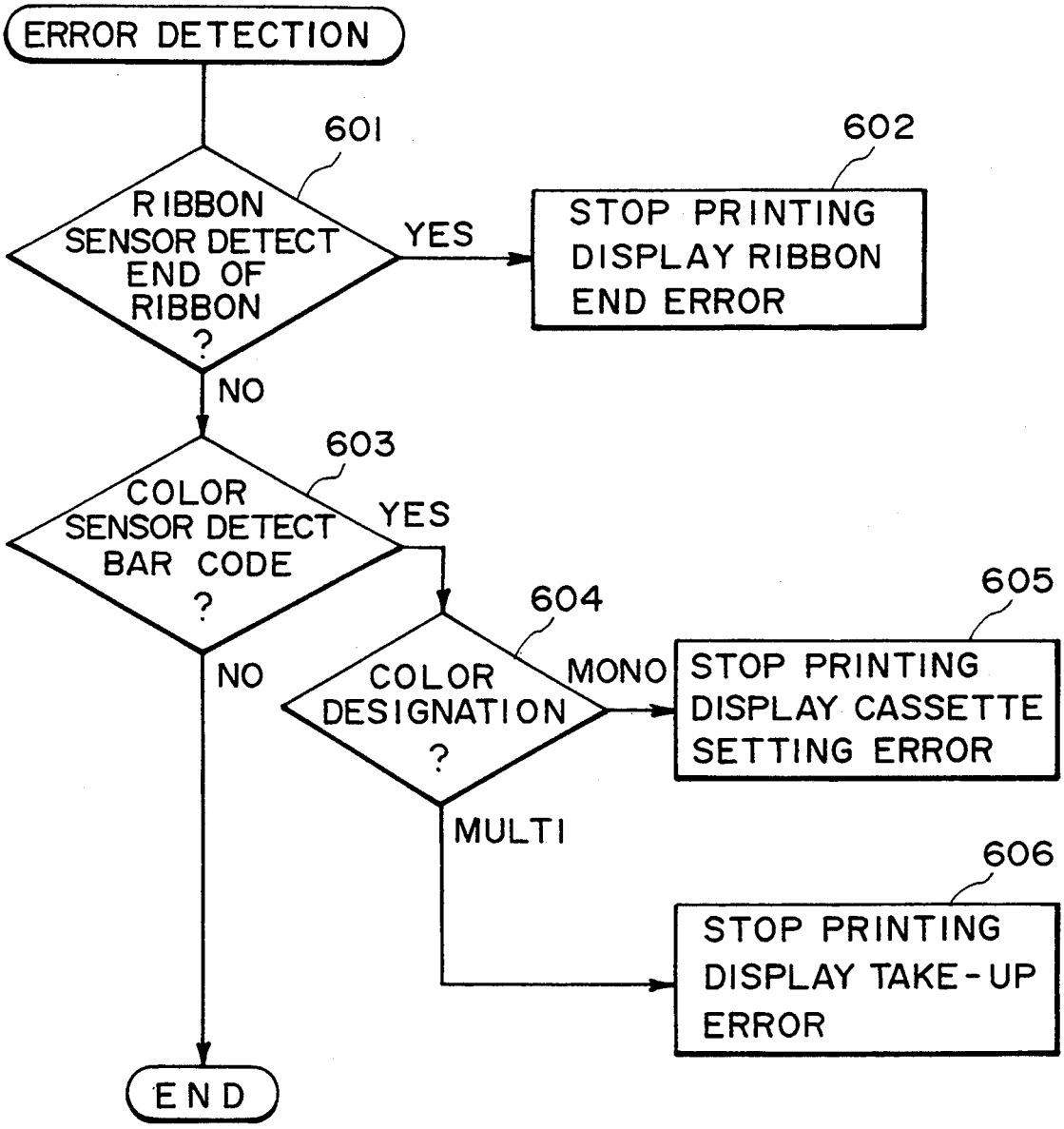
FIG. 24 is a flow chart illustrating a process for detecting an error shown in FIGS. 22A and 22B.

FIG. 24 is a flow chart of the process for detecting any error during the printing, executed in the sequence shown by the flow chart in FIGS. 22A and 22B. The error detecting operation will be explained with specific reference to this Figure.

The error detecting routine-is executed during the printing at a predetermined interval, e.g., in response to each of the driving pulses for driving the carriage motor M2, for each of the heat cycles of the thermal head 18,and so forth. Referring to FIG. 24, a judgment is conducted by the ribbon sensor S2 as to whether the present state is a ribbon-end state.

When the ribbon-end state is detected, the process proceeds to Step 602 in which the printing is suspended while stopping the carriage 14. Then, the head motor M3 is started to effect the head-up operation so as to set the thermal head 18 in the up position, while dismissing the ribbon take-up function. Thereafter, the display is conducted to inform the operator of the occurrence of the ribbon-end state.

In Step 601, when the ribbon-end state is not detected, the CPU judges that the present state is an ordinary state, so that the process proceeds to Step 603 in which a judgment is conducted as to whether the bar code is detected by the color sensor S3.

The fact that the bar code is detected means that the bar code portion is heated by the thermal head 18 for printing. The heating of the bar code portion is an extraordinary condition. In such a case, the process proceeds to Step 604.

In Step 604, a judgment is conducted as to whether the designated color is a monochromatic color or multi-color. The fact that the designated color is monochromatic means that the multi-color ink ribbon cassette has been erroneously loaded despite that the monochromatic color has been designated in the printing menu. In this case, therefore, the process proceeds to Step 605 so as to stop the printing, while indicating the cassette setting error on the display.

If the judgment in Step 604 shows that the designated color is the multi-color, it is judged that the bar code portion has been wrongly heated for printing though there is no error in the setting of the cassette. In such a case, the process proceeds to Step 606 so as to stop the printing while indicating occurrence of the ribbon take-up error on the display.

When no bar code is detected in Step 603, i.e.,when the answer is NO, the CPU judges that the printing is being executed correctly, thus completing the error detecting operation.

The indication of occurrence of an error is conducted typically by means of a CRT, but the invention does not exclude the use of any other suitable indicating means such as activation of a buzzer or lighting up of a warning lamp as shown in FIG. 16.

It is thus possible to detect any error occurring during the printing, by executing the error detection routine explained in connection with FIG. 24.

In the described embodiment, the recording medium may be a recording paper such as a copy paper, a transparent plastic sheet used in overhead projectors, and so forth.

The heating of the ink ribbon, which is effected in the described embodiment by the thermal head 18, may be effected by any other suitable heating means such as infrared rays or a laser beam.

Figure 25:
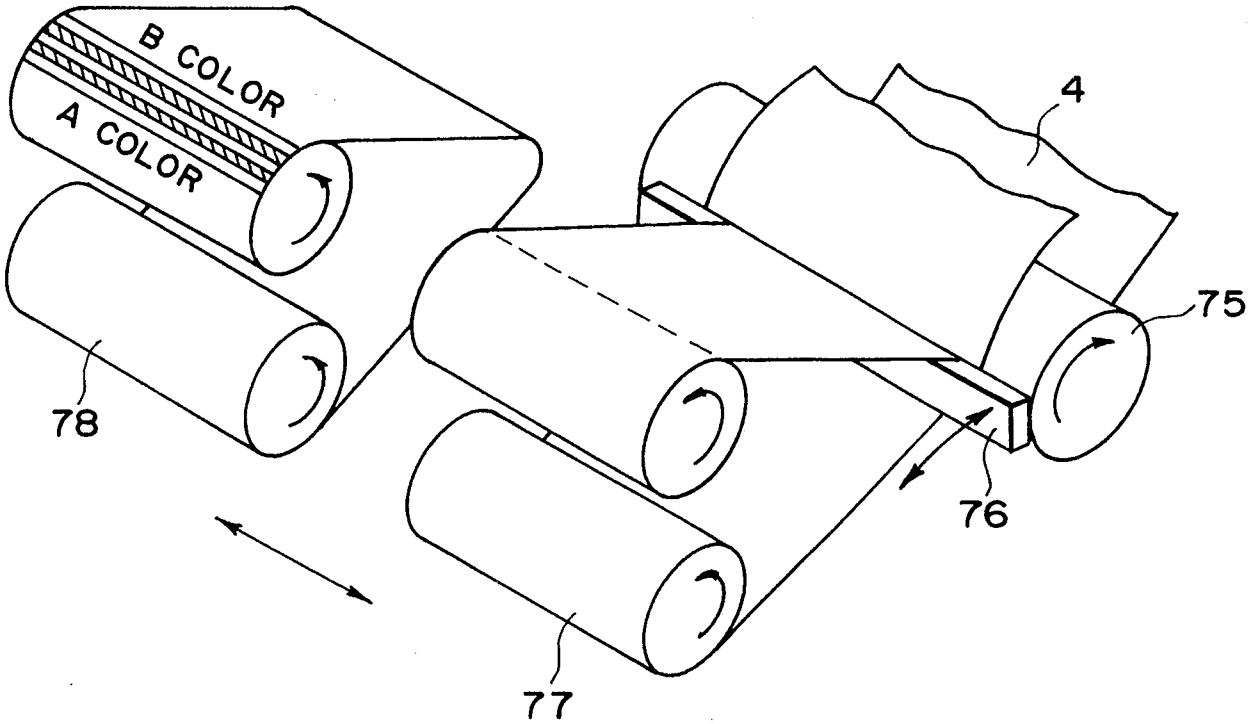
FIG. 25 is a perspective view of a recording portion of a full-line type image recording apparatus according to the embodiment utilizing the present invention.

It is also to be noted that the printing apparatus of the invention may be realized in the form of a full-line printing type having a heating means such as a thermal head extending over the entire length of the print line as shown in FIG. 25, though the printing apparatus of the described embodiment is of serial printing type in which the thermal head 18 is moved reciprocally along the recording sheet in the recording direction.

More specifically, in FIG. 25, a reference numeral 4 denotes a recording sheet, 75 designates a platen, 76 designates a full-line type thermal head, 77 designates a full-line type monochromatic ink ribbon, and 78 designates a full-line type multi-ink ribbon. Thus, the arrangement is basically the same as that in the embodiment described before.

The above-stated embodiment illustrated the ink ribbon cassette attachable to the apparatus which accommodates the ink ribbon in a case thereof, it should be understood that the present invention is not limited to the embodiment, an ink which is wound on the reel can be also used.

Furthermore, the recording apparatus of the invention can be embodied in such a manner that the ink ribbon cassette is kept stationary, though the ink ribbon cassette in the described embodiment is carried by the carriage 14 so as to be moved reciprocally.

Needless to say, the stack of the ink ribbon cassettes may be constituted by three or more ink ribbon cassettes, as well as by two ink ribbon cassettes as in the described embodiment.

Similarly, the multi-color ink ribbon, which has successive regions of three different colors demarcated by bar codes, may be substituted by a ribbon having successive regions of two colors or four or more colors. Even a multi-color ink ribbon having a multiplicity of layers of ink applied to the base film can be used successfully. Thus, the recording apparatus of the present invention can be carried out regardless of the type of the multi-color ink ribbon.

The platen used in the recording apparatus of the invention may be a flat tabular platen or a cylindrical platen which also serves as a sheet feeding roller. Although the description has been made as to the case where the printing is effected thermally by, for example, the thermal head, this is not exclusive and the present invention can be applied to all types of printing apparatus which makes use of the ink ribbon, e.g., an impact type printer which has a wire-dot type printhead.

Obviously, the described embodiment may be modified such that the ink ribbon cassette having black ink ribbon is placed in the lower stage of the stack of the cassettes while the multi-color ink ribbon cassette is placed in the upper stage of the stack, though a reversed cassette arrangement has been described.

As described above, the present embodiment has an advantage that, when the last recording color and its recording amount are stored and the proceeding recording information is identical with the last recording color and the last color still remains, the unused portion of the last half of the ink ribbon is used continuously to the end of the ribbon, therefore waste consumption and operation of the multi-colored ink ribbon are prevented to obtain the efficient recording.

Additionally, the present invention, can provide an image recording apparatus in which multi-image recording is efficiently performed.

We claim:

1. An image recording apparatus for recording a multi-colored image on a recording medium by using a multi-colored ink ribbon having a plurality of color frames, said apparatus comprising:

memory means for storing a recording color and a recording amount of a finally recorded color remaining in a given said color frame on said ink ribbon at a final recording in a remaining portion; and controlling means for causing the ink ribbon to record images using a portion of the finally recorded color of the ink ribbon in said given color frame, and for controlling a recording color to be initially recorded in the next remaining portion so that it is the same color as the finally recorded color stored in said memory means when the finally recorded color of the ink ribbon has a remaining amount of color after recording in the remaining portion, wherein said controlling means uses the ink ribbon to record images from a portion of the finally recorded color of the ink ribbon in said color frame regardless of whether the remaining amount of the finally recorded color is less than a recording amount required to record in the next remaining portion.

2. An image recording apparatus according to claim 1, wherein the ink ribbon has ink of different colors which coats the ink ribbon in succession forming a stripe pattern normal to a widthwise direction of the ink ribbon.

3. An image recording apparatus according to claim 1, wherein the remaining portion is a first line range and the next remaining portion is a second line range.

4. An image recording method for recording a multi-colored image on a recording medium by using a multi-colored ink ribbon having a plurality of color frames, said method comprising steps of:

storing a recording color and a recording amount of a finally recorded color remaining in a given said color frame at a final recording in a remaining portion; and causing the ink ribbon to record images using a portion of the finally recorded color in said given color frame of the ink ribbon and, for controlling a recording color to be initially recorded in the next remaining portion so that it is the same as the finally recorded color stored when the finally recorded color of the ink ribbon has a remaining amount after recording in the remaining portion, wherein the ink ribbon is used to record images from a portion of the finally recorded color of the ink ribbon in said color frame regardless of whether the remaining amount of the finally recorded color is less than a recording amount required to record in the next remaining portion.

5. An image recording method according to claim 4, wherein the ink ribbon has ink of different colors which coats the ink ribbon in succession forming a stripe pattern normal to a widthwise direction of the ink ribbon.

6. An image recording method according to claim 4, wherein the remaining portion is a first line range and the next remaining portion is a second line range.

7. An image recording apparatus for recording a multi-colored image on a recording medium by using a multi-colored ink ribbon having a plurality of color frames, said apparatus comprising:

memory means for storing a recording color and a remaining amount of a finally recorded color remaining in a given said color frame on said ink ribbon at a final recording in a remaining portion;

recording means for recording by transferring an ink from said ink ribbon to said recording medium; and counting means for counting down the remaining amount of recording color in said given color frame in synchronism with the image recording when the ink ribbon has a remaining amount of finally recorded color in advance of recording the next remaining portion, wherein said controlling means uses the ink ribbon to record images from a portion of the finally recorded color of the ink ribbon in said given color frame regardless of whether the remaining amount of the finally recorded color is less than a recording amount required to record in the next remaining portion.

8. An image recording apparatus according to claim 7, wherein the ink ribbon has ink of different colors which coats the ink ribbon in succession forming a stripe pattern normal to a widthwise direction of the ink ribbon.

9. An image recording apparatus according to claim 7, wherein the remaining portion is a first line range and the next remaining portion is a second line range.

10. An image recording method for recording a multi-colored image on a recording medium by using a multi-colored ink ribbon having a plurality of color frames, said method comprising steps of:

providing recording means for acting on said ink ribbon to record on said recording medium;

storing a recording color and a remaining amount of a finally recorded color at a final recording in a remaining portion of a given said color frame on said ink ribbon; and counting down a remaining amount of recording color in said given color frame in synchronism with the image recording when the finally recorded color of the ink ribbon has a remaining amount of finally recorded color in advance of recording the next remaining portion, wherein the ink ribbon is used to record images from a portion of the finally recorded color of the ink ribbon in said given color frame regardless of whether the remaining amount of the finally recorded color is less than a recording amount required to record in the next remaining portion.

11. An image recording method according to claim 10, wherein the ink ribbon has ink of different colors which coats the ink ribbon in succession forming a stripe pattern normal to a widthwise direction of the ink ribbon.

12. An image recording method according to claim 10, wherein the remaining portion is a first line range and the next remaining portion is a second line range.

13. An image forming apparatus for performing multi-color recording of a recording width on a recording medium, said apparatus comprising:

a recording head for recording on said recording medium, said recording head being disposed at an area;

carriage means for moving said recording head in a predetermined direction;

conveying means for conveying said recording medium in a conveyance direction to said area where said recording head is disposed and then discharging said recording medium from said area;

a multi-color ink ribbon having a width and having a plurality of different colored inks in a plurality of color frames disposed sequentially and repeatedly in a direction perpendicular to the conveyance direction of said recording medium, the width of said ribbon corresponding to the recording width; and memory means for storing a recording length of an area of the same color of said ribbon, a terminating color when recording is terminated and a recorded range thereof, and a next color to be next recorded to said recorded range and a non-recorded range, said memory means storing a value of a remaining amount of the recording length in said area of the terminating color in a given said color frame on said ink ribbon when recording by said ribbon is terminated, wherein when the terminating color when recording for said recorded range is terminated is the same as the next color to be next recorded in said non-recorded range and the ribbon has the remaining amount, an image is formed utilizing the colored ink in said non-recorded range of said given color frame from a position from a final recording position of said ribbon.

14. An image recording apparatus for recording on a recording medium using a multi-color ink ribbon continuously having a plurality of color frames each having a plurality of different colors in a predetermined order and in a longitudinal direction of said ink ribbon, said apparatus comprising:

discriminating means for discriminating whether a finally recorded color of given said color frame on said ink ribbon is identical with a color to be recorded next; and control means for controlling to perform recording using an unused portion of a single color area of the finally recorded color in said color frame regardless of whether a recording amount of the color to be recorded next is recordable by the unused portion of the single color area of finally recorded color when said discriminating means discriminates that the finally recorded color is identical with the color to be recorded next.

15. An image recording method for recording on a recording medium using a multi-color ink ribbon continuously having a plurality of color frames each having a plurality of different colors in a predetermined order and in a longitudinal direction of said ink ribbon, said method comprising the steps of:

discriminating whether a finally recorded color of given said color frame on said ink ribbon is identical with a color to be recorded next; and recording using an unused portion of a single color area of the finally recorded color in said color frame regardless of whether a recording amount of the color to be recorded next is recordable by the unused portion of the single color area of finally recorded color when in said discriminating step it is discriminated that the finally recorded color is identical with the color to be recorded next.

16. An image recording apparatus according to claim 14, wherein the ink ribbon has ink of different colors which coats the ink ribbon in succession forming a stripe pattern normal to a widthwise direction of the ink ribbon.

17. An image recording apparatus according to claim 14, wherein the finally recorded color is recorded in a first line range and the color to be recorded next is to be recorded in a second line range.

18. An image recording method according to claim 15, wherein the ink ribbon has ink of different colors which coats the ink ribbon in succession forming a stripe pattern normal to a widthwise direction of the ink ribbon.

19. An image recording method according to claim 15, wherein the finally recorded color is recorded in a first line range and the color to be recorded next is to be recorded in a second line range.

* * * * *

UNITED STATES PATENT AND TRADEMARK OFFICE

CERTIFICATE OF CORRECTION

PATENT NO. : 5,445,464

DATED : August 29, 1995

INVENTOR(S) : OSAMU ASAKURA, ET AL.

It is certified that error appears in the above-identified patent and that said Letters Patent is hereby corrected as shown below:

IN THE DRAWINGS

Sheet 13 of 22: "SLAKENING" should read --SLACKENING--.

Sheet 14 of 22: "SLAKENING" should read --SLACKENING--.

Sheet 19 of 22: "PREDETERMIND" should read --PREDETERMINED--.

COLUMN 1

Line 47, "undesirably" should read --undesirable--.

COLUMN 3

Line 11, "year 7a" should read --gear 7a--.

Line 61, "FIG. 22A" should read --FIGS. 22A--.

COLUMN 4

Line 14, "key 1B," should read --keys 1B,--.

UNITED STATES PATENT AND TRADEMARK OFFICE

CERTIFICATE OF CORRECTION

PATENT NO. : 5,445,464

DATED : August 29, 1995

INVENTOR(S) : OSAMU ASAKURA, ET AL.

It is certified that error appears in the above-identified patent and that said Letters Patent is hereby corrected as shown below:

COLUMN 5

Line 66, "fix" should read --fixes--.

COLUMN 6

Line 65, "constitute" should read --constitutes--.

COLUMN 7

Line 51, "is" should read --are--.

COLUMN 10

Line 25, "At" should read --at--.

COLUMN 11

Line 2, "where" should read --for--.

COLUMN 12

Line 63, "sensor" should be deleted.

UNITED STATES PATENT AND TRADEMARK OFFICE

CERTIFICATE OF CORRECTION

PATENT NO. : 5,445,464

DATED : August 29, 1995

INVENTOR(S) : OSAMU ASAKURA, ET AL.

It is certified that error appears in the above-identified patent and that said Letters Patent is hereby corrected as shown below:

COLUMN 13

Line 6, "head 8" should read --head 18--.

COLUMN 15

Line 54, "dares" should read --attempts--.

COLUMN 18

Line 16, "position-and" should read --position and--.

Line 22, "information,-" should read --information,--.

UNITED STATES PATENT AND TRADEMARK OFFICE

CERTIFICATE OF CORRECTION

PATENT NO. : 5,445,464

DATED : August 29, 1995

INVENTOR(S) : OSAMU ASAKURA, ET AL.

It is certified that error appears in the above-identified patent and that said Letters Patent is hereby corrected as shown below:

COLUMN 19

Line 48, "length e" should read --length l--.

COLUMN 20

Line 25, "routine-is" should read --routine is--.

Signed and Sealed this

Fourteenth Day of May, 1996

*Attest:*

*Attesting Officer*

BRUCE LEHMAN

*Commissioner of Patents and Trademarks*